US007299813B2

(12) United States Patent
Ochi

(10) Patent No.: US 7,299,813 B2
(45) Date of Patent: Nov. 27, 2007

(54) FOLDABLE TENT

(75) Inventor: Yorozu Ochi, Imabari (JP)

(73) Assignee: Ochi Industries Corporation, Imabari-Shi Ehime (JP)

( * ) Notice: Subject to any disclaimer, the term of this patent is extended or adjusted under 35 U.S.C. 154(b) by 0 days.

(21) Appl. No.: 10/570,131

(22) PCT Filed: Sep. 2, 2003

(86) PCT No.: PCT/JP03/11185

§ 371 (c)(1),
(2), (4) Date: Mar. 1, 2006

(87) PCT Pub. No.: WO2005/024158

PCT Pub. Date: Mar. 17, 2005

(65) Prior Publication Data

US 2007/0012347 A1 Jan. 18, 2007

(51) Int. Cl.
*E04H 15/50* (2006.01)

(52) U.S. Cl. ..... 135/145; 135/131; 135/159; 135/135; 403/170

(58) Field of Classification Search ..... 135/130–131, 135/135, 143–145, 120.3, 147, 159; 403/170–172, 403/217–218; 52/109, 641, 646
See application file for complete search history.

(56) References Cited

U.S. PATENT DOCUMENTS

| | | | | |
|---|---|---|---|---|
| 4,558,713 | A * | 12/1985 | Hagler et al. | 135/159 |
| 4,779,635 | A | 10/1988 | Lynch | |
| 5,794,640 | A * | 8/1998 | Jang | 135/131 |
| 5,813,425 | A * | 9/1998 | Carter | 135/145 |
| 6,397,872 | B1 * | 6/2002 | Carter | 135/145 |
| 6,598,614 | B2 * | 7/2003 | Liu | 135/131 |
| 6,929,017 | B2 * | 8/2005 | Byun | 135/145 |
| 7,025,075 | B2 * | 4/2006 | Suh | 135/145 |
| 2005/0028856 | A1 * | 2/2005 | Seo | 135/131 |

FOREIGN PATENT DOCUMENTS

| | | | |
|---|---|---|---|
| FR | 2849668 | * | 7/2004 |
| JP | 2597670 | B2 | 4/1997 |
| JP | 3042113 | U | 10/1997 |
| JP | 3057223 | U | 4/1999 |
| JP | 2949648 | B2 | 7/1999 |
| JP | 3060081 | U | 7/1999 |
| JP | 2001-3604 | * | 1/2001 |
| JP | 2001-3604 | A | 1/2001 |
| JP | 2001-288933 | A | 10/2001 |
| JP | 2003-227249 | * | 8/2003 |
| JP | 2003-321951 | A | 11/2003 |

* cited by examiner

*Primary Examiner*—Winnie Yip
(74) *Attorney, Agent, or Firm*—Birch, Stewart, Kolasch & Birch, LLP

(57) ABSTRACT

A foldable tent (1), wherein a covering is supported by a plurality of columns (2) and an outer peripheral frame (3) and reinforcement frames (4) connected to the columns (2), the reinforcement frames (4) are formed so as to pass through the inside of a polygon in plan view formed of the outer peripheral frame (3) and disposed so as to connect the columns to the center of the polygon to more increase the strength thereof over a conventional foldable tent, parts of unit pipe bodies forming the reinforcement pipe units (41, 42) of the reinforcement frames (4) are horizontal relative to an installation surface or downwardly titled toward the center thereof to smoothly fold the reinforcement pipe elements (41, 42) when the tent is dissembled, and the reinforcement frames (4) are supported on the columns (2) or on the columns (2) through play allowing the reinforcement frames (4) to move within a specified range from a center column (5) in a generally circumferential direction to smoothly fold the foldable tent.

9 Claims, 17 Drawing Sheets

FOLDABLE TENT

FIELD OF THE INVENTION

The present invention is related to a foldable tent that is constructed during outdoor events, for example.

BACKGROUND ART

Conventionally, tents with a structure wherein a covering is supported by a plurality of poles and frames that are connected to the poles have been widely used.

There are various types of structure for the poles and frames, and the structure stated in JP patent No. 2949648 and JP unexamined patent application publication No. 2001-288933 is an example of a foldable tent wherein the poles and frames are supported as they can slide and move rotationally, thus can be folded easily.

These tents 101 shown in FIGS. 16 and 17 are provided with juxtaposing outer peripheral frames 103, which link the poles 102 extending upward from the ground or the like where the tent is constructed. The outer peripheral frames 103 are linked by reinforcement frames 104, and a center pole 105 is provided at an intersection of these reinforcement frames 104, that is, the center of a polygon formed by the outer peripheral frames 103.

As shown in FIG. 16, a covering 106 forming a roof of this tent is supported by the outer peripheral frames 103 and the center pole 105.

Since the reinforcement frames 104 in the conventional tent 101 like this are formed parallel to the outer peripheral frames 103, there is a problem regarding the outer peripheral frames 103 that may be twisted subject to an external force such as wind.

The covering 106 is supported by the center pole 105, so the roof having a top is formed with this tent 101 shown in FIG. 16. Because of this, it is possible to prevent water in raining from gathering on the covering during the construction of the tent.

The center pole 105 is supported by the reinforcement frames 104 at the lower edge, however, since the reinforcement frames 104 are disposed parallel to where the tent 101 is constructed, the length of the center pole 105 should be extended in order to make the top of the roof higher. But excessive lengthening of the center pole 105 may cause less stability in support of the roof against wind and other factors.

In view of the above, an object of the present invention is to provide a foldable tent that has sufficient strength and is simple to assemble, further having stability after construction.

DISCLOSURE OF THE INVENTION

In order to solve the above-mentioned disadvantages, a first aspect of the present invention, provides a foldable tent in which a covering is supported by a plurality of poles and a plurality of frames connected to the poles. The frames of the foldable tent are comprised of a plurality of outer peripheral frames that define the outer peripheral shape of the frames and a plurality of reinforcement frames disposed inside of which the outer peripheral frames surround. The outer peripheral frames are disposed on the upper portion of the poles to link the neighboring poles and form a polygon at least with each of the poles positioned at the vertexes of the polygon in a plan view. Each of the poles is provided with the reinforcement frame facing towards a direction of the center of the polygon. A center pole is provided at the center of the polygon and is supported by the reinforcement frames. Each of the outer peripheral frames and each of the reinforcement frames is comprised of two pairs of combined pipe units. At least one intersecting point is formed at each of the pipe units. One of the pipe units and the other pipe unit are joined at the intersecting points to allow rotation. The outer peripheral frames and the reinforcement frames are foldable by means of changing the angle of the pipe units. The covering is supported by the poles, the outer peripheral frames and the reinforcement frames.

According to a second aspect of the present invention, plurality of unit pipe bodies are connected at folding points to allow rotation. Each of the outer peripheral pipe units is formed with at least two intersecting points and with a folding point formed in the manner to be sandwiched by the intersecting points. The unit pipe bodies of one of the outer peripheral pipe units and the other outer peripheral pipe unit are connected at the intersecting points to allow rotation. The outer peripheral frames are foldable at the folding points. The reinforcement pipe units on the reinforcement frames are comprised of a plurality of unit pipe bodies connected at a folding point to allow rotation. Each of the reinforcement pipe units is formed with at least two intersecting points and with a folding point formed in the manner to be sandwiched by the intersecting points. The unit pipe bodies of one of the reinforcement pipe units and the other reinforcement pipe unit are connected at the intersecting points to allow rotation. The reinforcement frames are foldable at the folding points. The connection point on the upper side of the reinforcement pipe units with respect to the center pole is at a higher position compared to the connection point on the lower side of the reinforcement pipe units with respect to the poles in construction of the tent on a horizontal surface.

According to a third aspect of the present invention a plurality of unit pipe bodies are connected at the folding points to allow rotation. At least one of the unit pipe bodies is disposed level or aslant downward to the direction of the center in construction of the tent on a horizontal surface.

According to a fourth aspect of the present invention, the connections between the poles and the reinforcement frames and between the center pole and the reinforcement frames are respectively made at two connection points. One of the two connection points is allowed to slide upward and downward as well as to rotate. The other connection point is not allowed to slide upward and downward but to rotate. The length on the pole side is longer than the length on the center pole side regarding the sliding length in the upward and downward direction at one of these two connection points.

According to a fifth aspect of the present invention, at least one of the connection points for the reinforcement frames is supported to have play that allows movement in the direction to intersect the poles or to intersect the center pole, regarding the connection between the poles and the reinforcement frames and the connection between the center pole and the reinforcement frames.

According to a sixth aspect of the present invention, the outer peripheral shape defined by the outer peripheral frame is a rectangle formed by two opposing long sides and two short sides disposed at both ends of the long sides.

According to a seventh aspect of the present invention, the reinforcement frames are supported at one of the connection points on the pole side and on the center pole side to have play for movement within a specified range in the substantially periphery direction on the basis of the poles or on the center poles.

According to an eighth aspect of the present invention, each of the pipe units is comprised of a plurality of unit pipe bodies, and, regarding the unit pipe bodies that are supported to have the play with respect to the poles or the center pole, the supporting is made via a bracket provided on the poles or the center pole. The bracket has an inner surface on one side and an opposing inner surface on the other side, and a terminal connection member of the unit pipe body is disposed between the inner surfaces. The unit pipes are pivotally supported by a support pin disposed between the interior surfaces of the bracket to allow rotation around the support pin. The terminal connection member of the unit pipe body has a tapering wedge shape. On one side of the terminal connection member is provided a parallel surface that is parallel in the longitudinal direction of the unit pipe body. On the other side of the terminal connection member is provided a flat sloping surface that diminishes the distance between the parallel surface and the face as it goes towards the terminal side. Wide holes are formed on the terminal connection member in the vertical direction with respect to the parallel surface, penetrating the terminal connection member, and extending in the longitudinal direction of the unit pipe body. The terminal connection member is movable with respect to the bracket within a range from a status where the inner surface of the bracket and the parallel surface touch, while there is a gap between the inner surface on the other side and the sloping surface of the terminal connection member, to a status where there is a gap between the inner surface of the bracket and the parallel surface of the terminal connection member, while the inner surface on the other side and the sloping surface of the terminal connection member touch.

BEST MODE OF CARRYING OUT THE INVENTION

Figure 1:
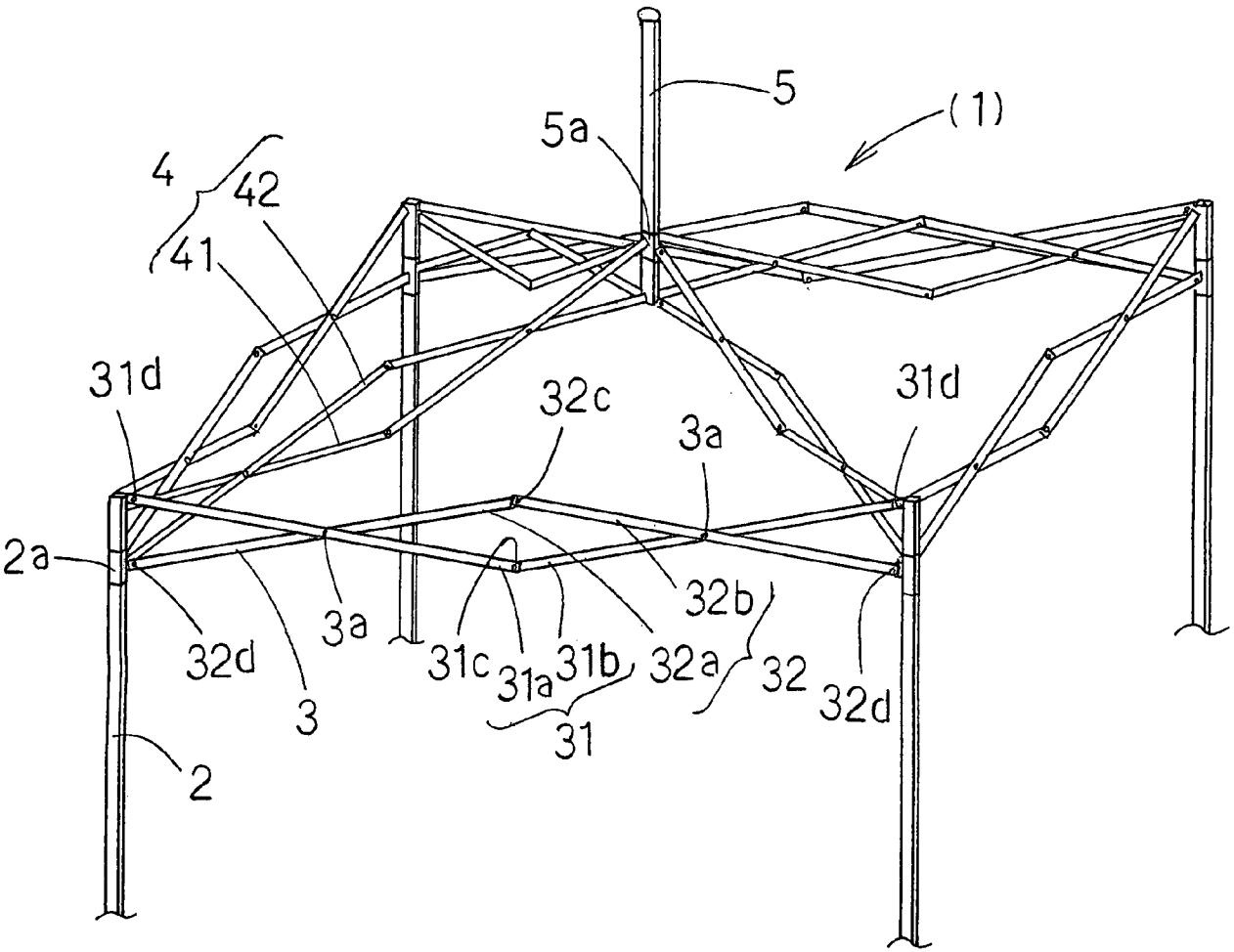
FIG. 1 is a perspective view showing the structure of the tent related to a first embodiment of the invention of this application.
Figure 2:
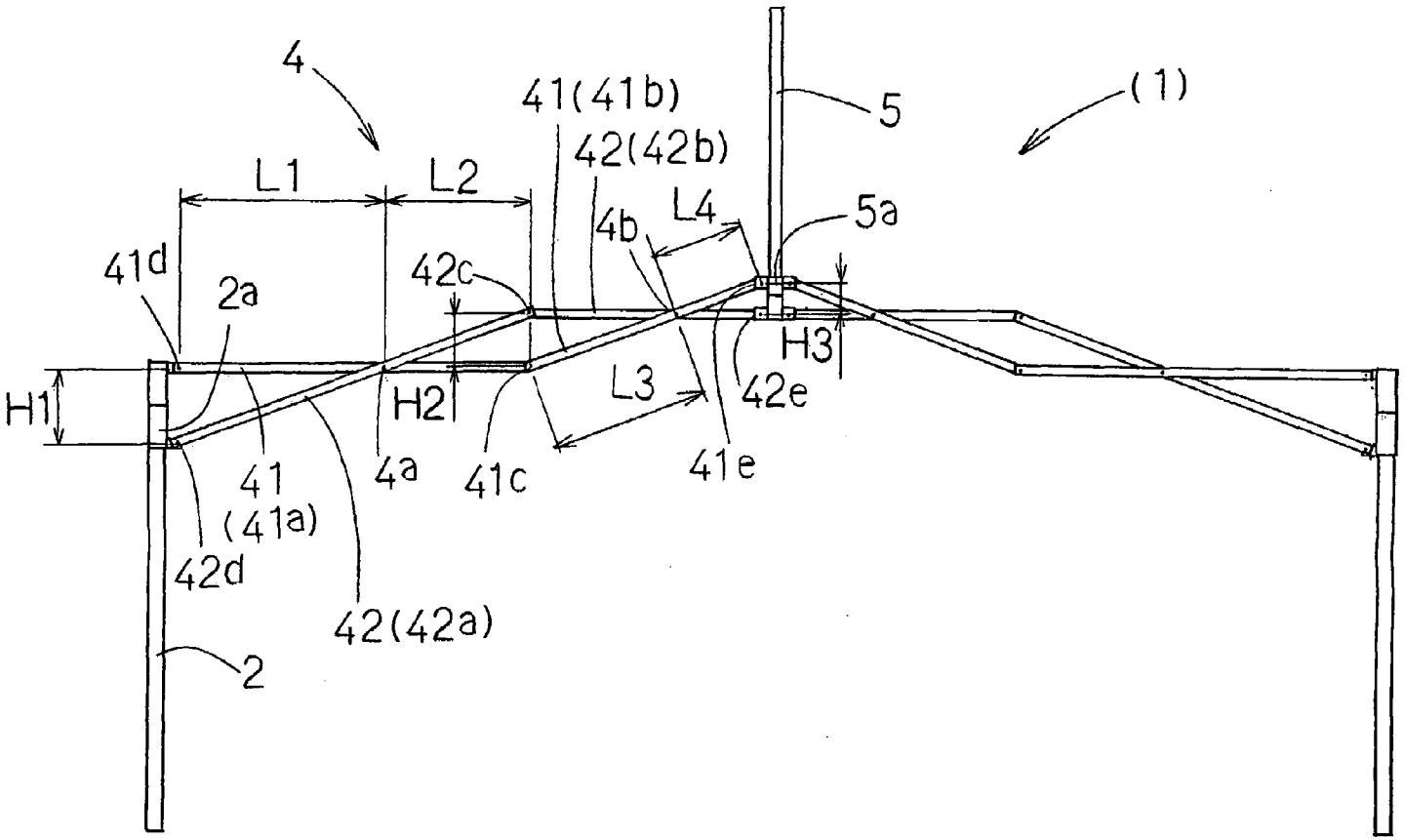
FIG. 2 is a descriptive view showing the structure of the tent of the first embodiment.

In the following a first embodiment of the present invention will be described referring to the drawings. FIG. 1 is a perspective view showing the structure of the tent of the embodiment. FIG. 2 is a descriptive view showing the structure of the reinforcement frame.

Figure 16:
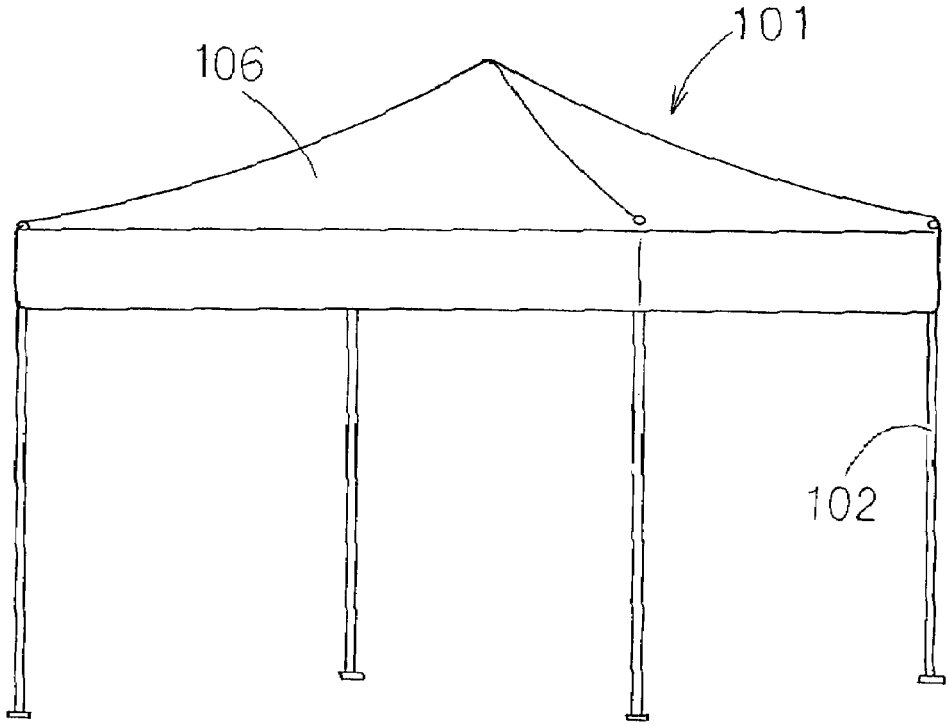
FIG 16 PRIOR ART
FIG. 16 is a perspective view showing a conventional tent.

A foldable tent related to the present invention is supposed to allow easy construction and disassembling outdoors as a temporary tent. Specifically, as shown in FIG. 1, in order to be foldable, the tent is a combination of poles 2, outer peripheral frames 3 and reinforcement frames 4, both of which are connected as frames to the poles 2, and a center pole 5, wherein a covering made of a soft resin or the like is supported over the members, as shown in FIG. 16, thus protecting against sunshine, rain and the like.

A pole 2 is a bar-shaped member with one end disposed on where the tent is constructed such as the ground, and with the other end disposed upward. In this embodiment, four poles 2 are provided for one tent 1, positioned at the vertexes of a substantial square in a plan view, standing upright on the constructing site. For the material of the pole 2, a straight and square pipe is used in this embodiment.

The pole 2 is not limited to this embodiment as described above, and may be modified in various shapes. For example, a curved member may be used, and the members may be disposed in a direction diagonal to the constructing site.

As for the pole 2, a plurality of bar-shaped members that are to be linked may be used. For example, a telescopic extendable system may be employed to have a small diameter member housed inside a larger diameter member. Or a hinge may be provided on a joint of the members to be able to fold them. Or a mating system may be employed to mate the members to extend further. In these cases, a fixing means is provided with the bar-shaped members to be able to adjust the length thereof. As an example for the means, a removable pin is inserted into a hole disposed on the lateral side of respective members. Or a protrusion pressed on by a spring is mated into a hole disposed on the lateral side of at least one of the members. In other words, various modes are employable as long as the outer peripheral frames 3 and the reinforcement frames 4 described later can be mounted on and the movement of a sliding member 2*a* that can slide along the poles 2 is not hindered. In this connection, not shown in the figure, the poles 2 of this embodiment are comprised of two bar-shaped members, which a plurality of holes to fix are formed with and the length of which is telescopically adjusted in three ways.

The number of poles for the tent 1 in this embodiment is four, but there is no limitation on this number as long as the poles 2 are three or more and positioned at least at vertexes forming a polygon in a plan view. Consequently, a rectangular shape in a plan view (described in the second embodiment later), a pentagon shape, or a shape consisting of six poles is included in this invention. Further, the poles 2 can be positioned inside the polygon, and the poles 2 provided in this manner can be functioned as a center pole 5 described later.

An outer peripheral frame 3, externally viewed juxtaposing, links the upper portion of the neighboring poles 2. In this embodiment, outer peripheral unit pipe bodies 31*a*, 31*b*, 32*a*, 32*b* in a straight bar-shape are combined for the outer peripheral frames 3, with the ends of the outer peripheral unit pipe bodies 31*a*, 31*b*, 32*a*, 32*b* connected to be pivotally supported to allow rotation.

In this embodiment, as shown in FIG. 1, the first outer peripheral unit pipe bodies 31*a*, 31*b* and second outer peripheral unit pipe bodies 32*a*, 32*b*, all of which have an equal length, are disposed between paring poles 2. The outer peripheral unit pipe bodies 31*a*, 31*b*, 32*a*, 32*b*, respectively shaped like a straight bar, are combined in pairs in such a manner to be pivotally supported at folding points 31*c*, 32*c* to form a V-shaped pipe unit. Thus, two pairs of the pipe units are disposed between the pairing poles 2. One of the two pairs of the pipe units, as a first outer peripheral pipe unit 31, is connected at a first connection point 31*d* to the upper end of the pole 2 such that the folding point 31*c* is positioned lower than the first connection point 31*d*, while the other pair, as a second outer peripheral pipe unit 32, is connected at a second connection point 32*d* to a sliding member 2*a* disposed on the pole 2 such that the second connection point 32*d* is positioned lower than the first connection point 31*d* of the first outer peripheral pipe unit 31 and such that the folding point 32*c* is positioned higher than the second connection point 32*d*. At intersecting points 3*a* where the first outer peripheral pipe unit 31 and the second outer peripheral pipe unit 32 cross, the outer peripheral unit pipe bodies 31*a*, 32*a* on each of the outer peripheral pipe unit 31, 32 are pivotally supported to allow rotation, and each of the outer peripheral unit pipe bodies 31*b*, 32*b* are pivotally supported to allow rotation as well. Consequently, in this embodiment, the two intersecting points 3*a* are formed on each of the outer peripheral pipe units 31, 32 in the manner to sandwich the folding points 31*c*, 32*c*.

Figure 10:
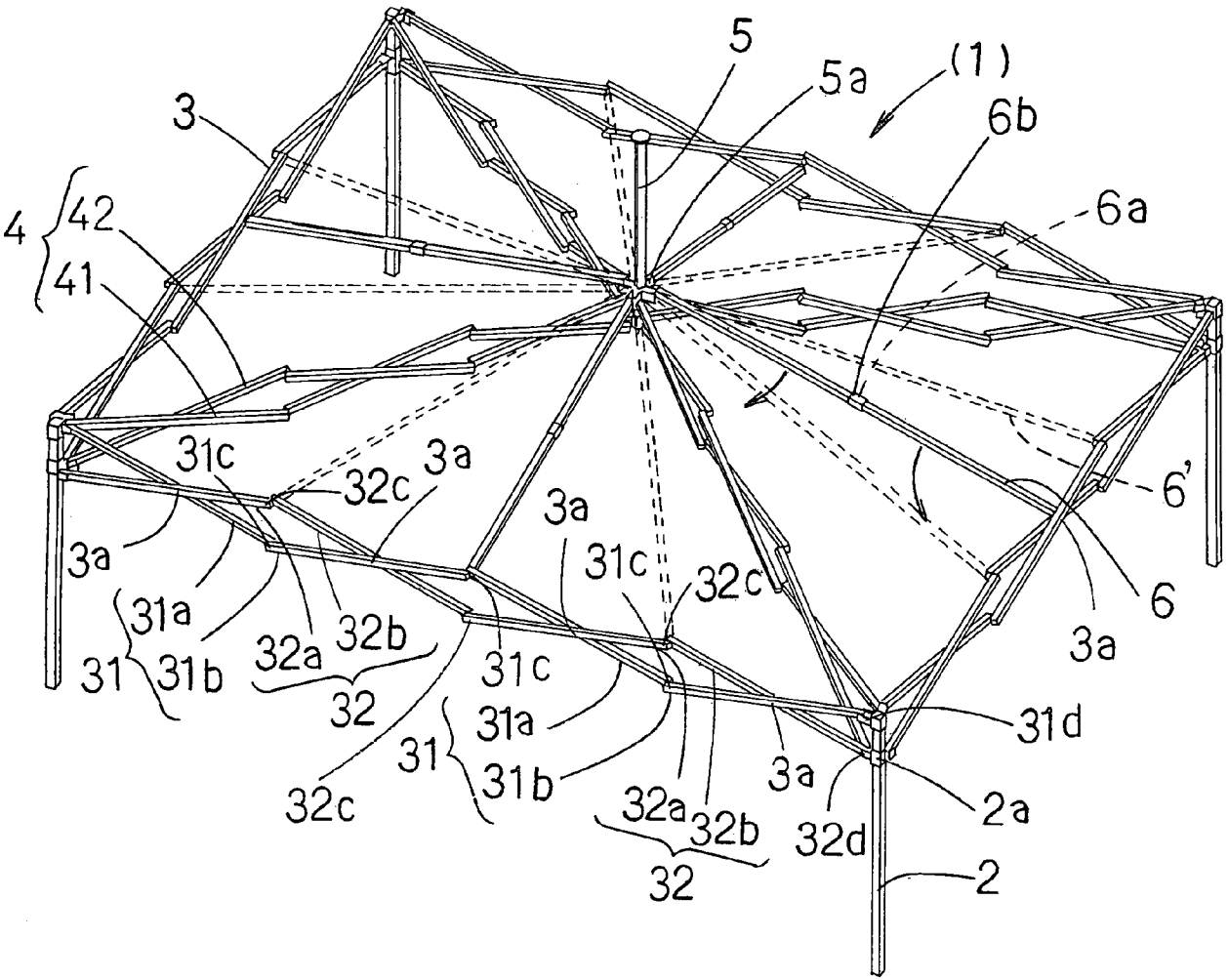
FIG. 10 is a perspective view showing the structure of the tent related to a second embodiment of the invention of this application.

Each of the outer peripheral unit pipe bodies 31*a*, 31*b*, 32*a*, 32*b* are not limited to this embodiment, and can be applied, for example, with a curved member or an outer peripheral pipe unit comprised of more components per a pair of the outer peripheral pipe units 31, 32, thereby having many intersecting points 3*a* and folding points 31*c*, 32*c* as shown in FIG. 10, which shows a second embodiment described later. In contrast to the description above, the outer peripheral pipe units 31, 32 can be respectively comprised of a single outer peripheral unit pipe body and pivotally supported by an intersecting point 3*a* only, forming an "X" type.

Regarding the connection points 31*d*, 32*d* of each of the outer peripheral pipe units 31, 32 to the poles 2, the first connection point 31*d* is connected by means of, for example, a pivot to allow rotation through a bracket secured to the upper end of the poles 2. The second connection point 32*d* is connected to allow rotation to a sliding member 2*a* provided in a manner to allow sliding along the pole 2, for example, by pivotal supporting.

The sliding member 2*a* in this embodiment has a short cylindrical shape provided such that it encircles the outer periphery of the pole 2, wherein a bracket is also provided for connecting the second outer peripheral pipe unit 32 to the outside of this sliding member 2*a*. Between the sliding member 2*a* and pole 2, a detachable fixing means is provided and makes fixing in constructing the tent. An example of the means is a removable pin inserting into a hole formed on the lateral side of each members or a protrusion that is pressed on by a spring disposed on the other side mating into a hole formed on the lateral side of at least either the pole 2 or the sliding member 2*a*.

The sliding member 2*a* is not limited to the description above and may have a structure that provides a bracket outside and slide inside the pole 2, and further may be modified to various modes as long as the second connection point 32*d* can slide along the pole 2.

Owing to the aforementioned structure, the outer peripheral frame 3 is formed in a juxtaposing shape in this embodiment, and each angle of the outer peripheral pipe units 31, 32 is changeable following movement that brings the pair of poles 2 closer and farther apart thereby folding and extending the outer peripheral frame 3.

And, the outer peripheral frame 3 in a plan view forms each side of the polygon with each of the poles 2 positioning at the vertexes thereby defining the outer periphery of the tent 1.

Figure 5A:
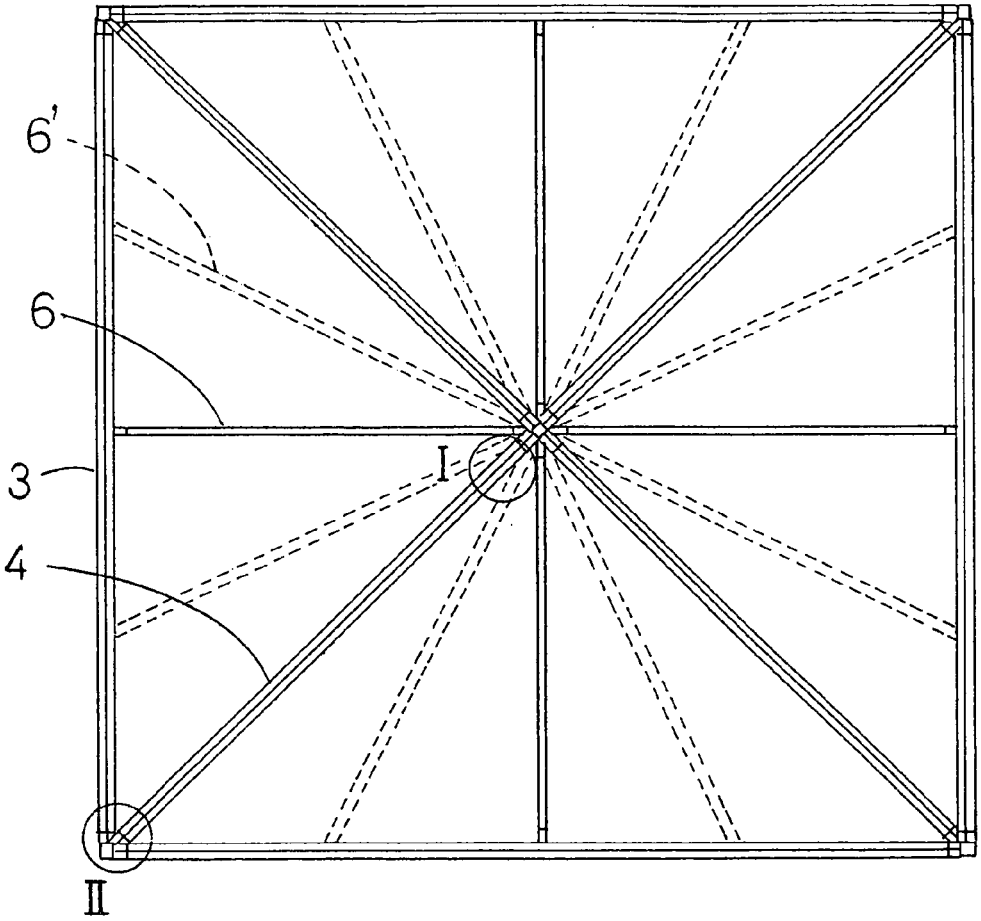
FIG. 5(A) is a descriptive view showing the structure of another embodiment of the tent.

A reinforcement frame 4, positioned inside the above-described polygon formed by the outer peripheral frame 3, is disposed so as to face towards a direction of the center of the polygon. The "center" here does not mean a geometric center in the polygon but means "inside" at most. In this embodiment, since the polygon is substantially a square, the reinforcement frame 4 in a plan view is positioned diagonally as shown in FIG. 5(A). Further, a center pole 5 is provided at the intersecting point of the reinforcement frame 4 being the center of the polygon, thereby supporting the covering. The reinforcement frame 4 is disposed between the pole 2 and the center pole 5, accordingly.

Though each of the reinforcement frames 4 in this embodiment is formed in an equal length, there is no limitation on this and a combination of reinforcement frames 4 with unequal lengths is applicable.

Figure 7:
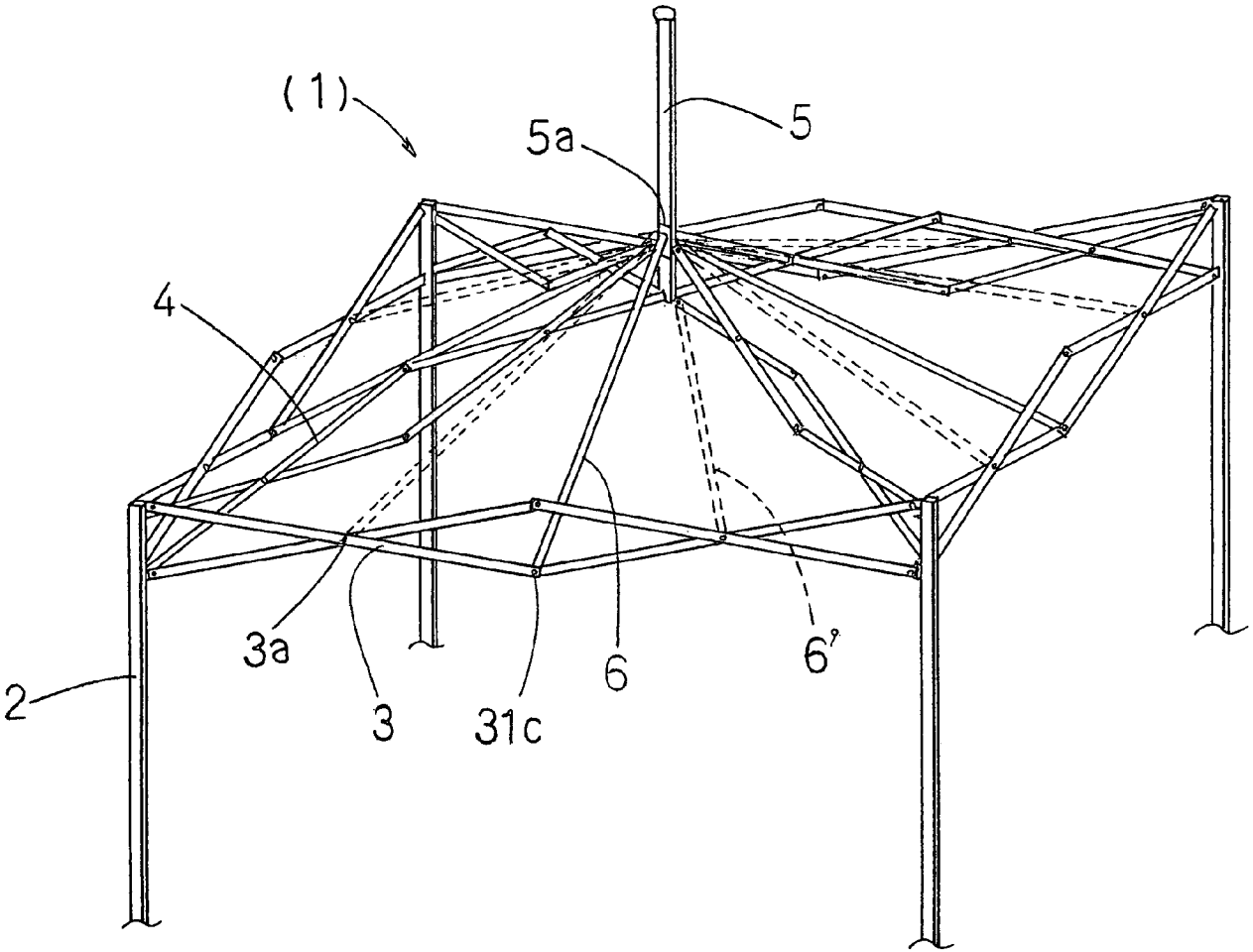
FIG. 7 is a perspective view showing a state in which a reinforcement member is attached to the tent of the first embodiment.
Figure 17:
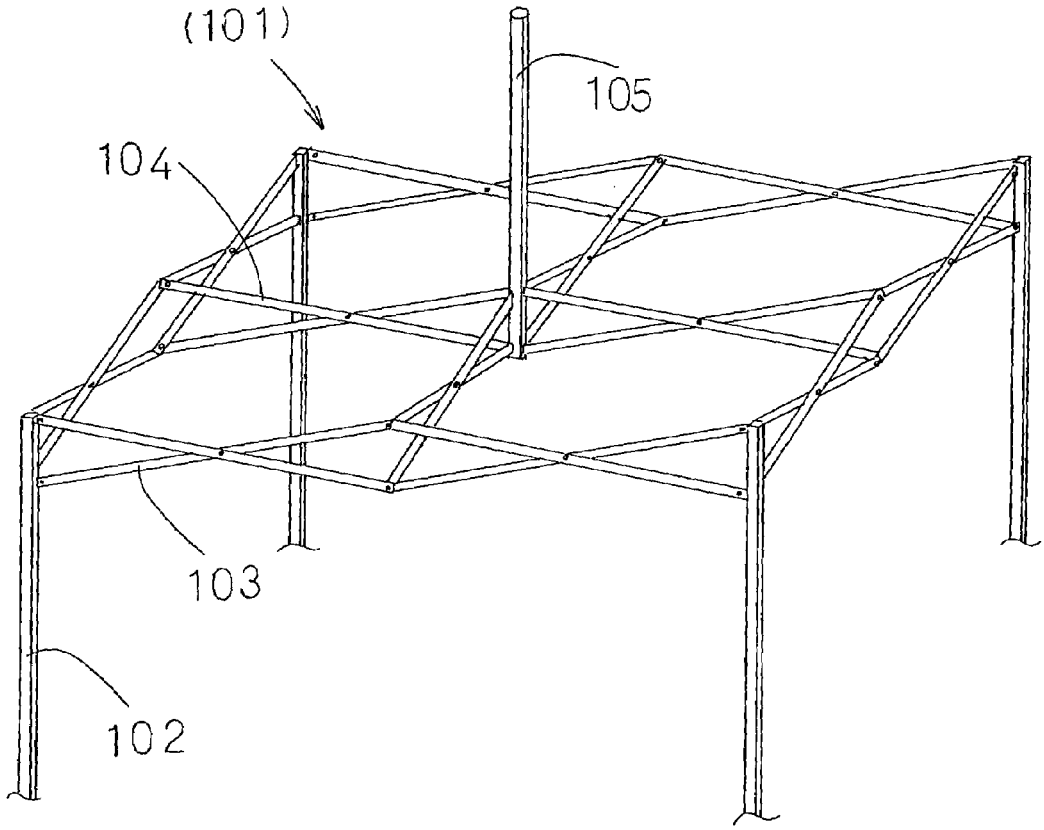
FIG 17 PRIOR ART
FIG. 17 is a perspective view showing the structure of a conventional tent.

Hereupon, as shown in FIG. 17, since the reinforcement frames 104 in a conventional foldable tent are formed so as to link the outer peripheral frames 103, it is necessary to separately mount another reinforcement member (not shown in the figure) such as a brace on the portion of the polygon that the outer peripheral frames 103 forms for the purpose of providing strength on the portion against shearing deformations, particularly. In this embodiment, however, the reinforcement frames 4 are formed diagonally in a substantial square formed by the outer peripheral frames 3, thereby improving the above-mentioned strength compared to a conventional foldable tent. Consequently, it is not especially required to provide a reinforcement member separately, and when a reinforcement member such as a reinforcement member 6 or a support reinforcement member 6' shown in FIGS. 7 and 10 is provided, the strength can be improved more.

The structure of this reinforcement frame 4 is basically the same as the outer peripheral frame 3 mentioned above, so the principal differences in view of the outer peripheral frame 3 will be described.

As described above, at the intersecting point of the reinforcement frame 4, the center pole 5 is provided that supports the covering. Regarding the tent 1 provided with the center pole 5 like this embodiment, a slant topping the portion supported by the center pole 5 is provided such that water such as rain does not gather on the covering while constructing the tent 1 in the rain. Thus, it is preferable for the top end of the center pole 5 to be disposed at a higher location. But excessive lengthening of the center pole 5 may cause less stability in support of the covering against wind and other factors.

In contrast to this, as shown in FIG. 2, when the tent 1 in the present invention is constructed on a horizontal surface, a center connection point 41*e* of the reinforcement frame 4 for the center pole 5 is provided at a higher position compared to the pole side connection point 42*d* of the reinforcement frame 4 for the pole 2, and the center pole 5 is stably supported. In addition, the inside of the tent can be spacious.

Also, like the outer peripheral frames 3, reinforcement unit pipe bodies 41*a*, 41*b*, 42*a*, 42*b* comprise the reinforcement frames 4, and are combined in pairs so as to form a V-shaped pipe unit. The two pairs of pipe units are disposed between the pole 2 and the center pole 5. However, these reinforcement unit pipe bodies 41*a*, 41*b*, 42*a*, 42*b* are different from the outer peripheral unit pipe bodies 31*a*, 31*b*, 32*a*, 32*b* of the outer peripheral frames 3 and all of them do not have an equal length.

Specifically, as shown in FIG. 2, a pair of the reinforcement frames 4, disposed between the pole 2 and the center pole 5 is comprised of the first pole side reinforcement unit pipe body 41*a*, the second pole side reinforcement unit pipe body 42*a*, the first center reinforcement unit pipe body 41*b*, and the second center reinforcement unit pipe body 42*b*. The first pole side reinforcement unit pipe body 41*a* and the second pole side reinforcement unit pipe body 42*a* are pivotally supported at a pole side intersecting point 4*a*, while the first center reinforcement unit pipe body 41*b* and the second center reinforcement unit pipe body 42*b* are pivotally supported at a center intersecting point 4*b*.

As is the case of the outer peripheral frames 3, the first pole side reinforcement unit pipe body 41*a* and the first center reinforcement unit pipe body 41*b* are pivotally supported at a folding point 41*c*, thus forming a first reinforcement unit pipe 41, while the second pole side reinforcement unit pipe body 42*a* and the second center reinforcement unit pipe body 42*b* are pivotally supported at a folding point 42*c*, thus forming a second reinforcement unit pipe 42.

Hereupon, in the first reinforcement unit pipe 41, when the length of the intervals defined at the intersecting points 4*a*, 4*b* and the folding point 41*c* are respectively, from the pole side, a first interval L1, second interval L2, third interval L3, and fourth interval L4, the intervals are formed to be shorter as heading to the center, i.e. L1>L2, L2=L3, and L3>L4 in the present invention. This relation is the same as the second reinforcement unit pipe 42. Consequently, among the distance H1 between the pole side connection point 41*d* of the first reinforcement unit pipe 41 and the pole side connection point 42*d* of the second reinforcement unit pipe 42, the distance H2 between the folding point 41*c* of the first reinforcement unit pipe 41 and the folding point 42*c* of the second reinforcement unit pipe 42, and the distance H3 between the center connection point 41*e* of the first reinforcement unit pipe 41 and the center connection point 42*e* of the second reinforcement unit pipe 42, the relation is H1>H2>H3.

The sum of the distance between the first connection point 31*d* and the intersecting point 3*a* on the outer peripheral frame 3, and the distance between the second connection point 32*d* and the intersecting point 3*a* on the same, and the sum of the distance (first interval L1) between the pole side connection point 41*d* and the pole side intersecting point 4*a* on the first reinforcement unit pipe 41 on the reinforcement frame 4, and the distance between the pole side connection point 42*d* and the pole side intersecting point 4*a* on the second reinforcement unit pipe 42 on the same, are formed to be equal, whereby the outer peripheral frame 3 and the reinforcement frame 4 move smoothly.

In contrast, the first reinforcement unit pipe 41 is connected to the pole 2 to allow rotation at the pole side connection point 41*d* on the upper end of the pole 2, and is also connected to the center pole 5 to allow sliding and rotation at the center connection point 41*e* on the sliding member 5*a*, the point being provided at higher than the lower end of the center pole 5 and higher than the pole side connection point 41*d*. This sliding member 5*a* is the same as the sliding member 2*a* provided on the pole 2 above.

The second reinforcement unit pipe 42 is connected to the pole 2 to allow sliding and rotation at the pole side connection point 42*d* on the sliding member 2*a* (in this embodiment, the outer peripheral frame 3 shares this sliding member 2*a*), the point being provided lower than the pole side connection point 41*d* connecting to the first reinforcement unit pipe 41, and is also connected to the lower end of the center pole 5 to allow rotation at the center connection point 42*e* on the lower end of the center pole 5, the point being provided at higher than the pole side connection point 42*d*.

Here, regarding the pole 2, the pole side connection point 41*d* of the first reinforcement unit pipe 41 is provided higher than the pole side connection point 42*d* of the second reinforcement unit pipe 42, while, regarding the center pole 5, the center connection point 41*e* of the first reinforcement unit pipe 41 is provided higher than the center connection point 42*e* of the second reinforcement unit pipe 42.

As described above, when folding and extending the reinforcement frame 4, like the outer peripheral frame 3, the center connection point 41*e* on the sliding member 5*a* slides up and down along the center pole 5 as does the pole side connection point 42*d* on the sliding member 2*a* along the pole 2. Regarding the moving length of each of the connection points 41*e*, 42*d*, it becomes larger on the pole 2 side than on the center pole 5 side. Especially in constructing the tent, owing to this, the principle of leverage applies to lifting the center pole 5 with a small effort, facilitating to spread the covering, thereby readily opening and closing the tent 1. The same effect can also be obtained by a structure that functions the same, such as three reinforcement unit pipe bodies in the second embodiment described later or a plurality of reinforcement unit pipes more than this, so it is not limited to each of the reinforcement unit pipe 41, 42 comprised of two reinforcement unit pipe bodies in this embodiment.

Also, in this embodiment, the first pole side reinforcement unit pipes 41*a* and the second center reinforcement unit pipes 42*b* are disposed level to the constructing site when the tent 1 is constructed. Although this portion is designed to face upwards 1 to 2 degrees above the horizontal, it becomes level when the tent 1 is actually constructed because of deviations due to the weight of each reinforcement unit pipe 41, 42 and wide holes 41*f*, 42*f* (41*h*, 42*h*) described later.

In contrast, the second pole side reinforcement unit pipe body 42*a* and the first center reinforcement unit pipe body 41*b*, which are respectively combined to the reinforcement unit pipes 41*a*, 41*b*, are disposed aslant upward to the center with respect to the constructing site.

In this invention, each of the reinforcement unit pipe bodies 41*a*, 42*b* are not limited to being disposed level as in this embodiment, but may be disposed aslant downward to the center. Also, one of the reinforcement unit pipe bodies 41*a*, 42*b* may be disposed level or aslant downward. Owing to this, the folding point 41*c* of the first reinforcement unit pipe 41 is smoothly folded such that it goes downward when the neighboring poles 2 are retracted in disassembling the tent 1.

Figure 3:
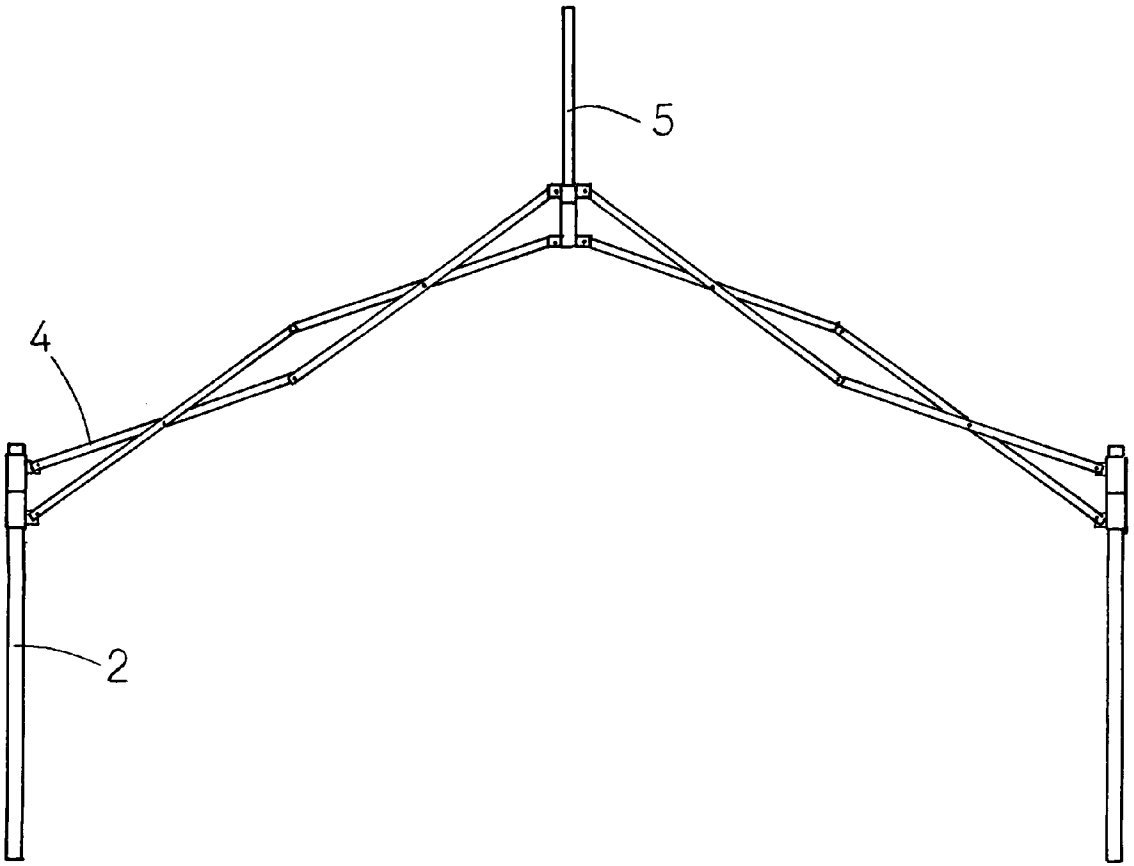
FIG. 3 is a descriptive view showing a modified structure of the tent of the first embodiment.

Hereupon, a modified example of this embodiment is shown in FIG. 3 for comparison. Different from the above-mentioned structure shown in FIG. 2, this is formed in a manner that the reinforcement frame 4 is directed upward. In this embodiment, it concerns that folding of the reinforcement unit pipes 41, 42 of the reinforcement frame 4 may cause scratching in disassembling the tent 1. Contrary to this, the structure of the reinforcement frame 4 shown in FIG. 2 has an advantage to achieve a smooth disassembling without hindering that may occur.

And, the second reinforcement unit pipe 42 in this embodiment has a trapezoid shape in a side view and stable strength to support the tent.

Figure 4:
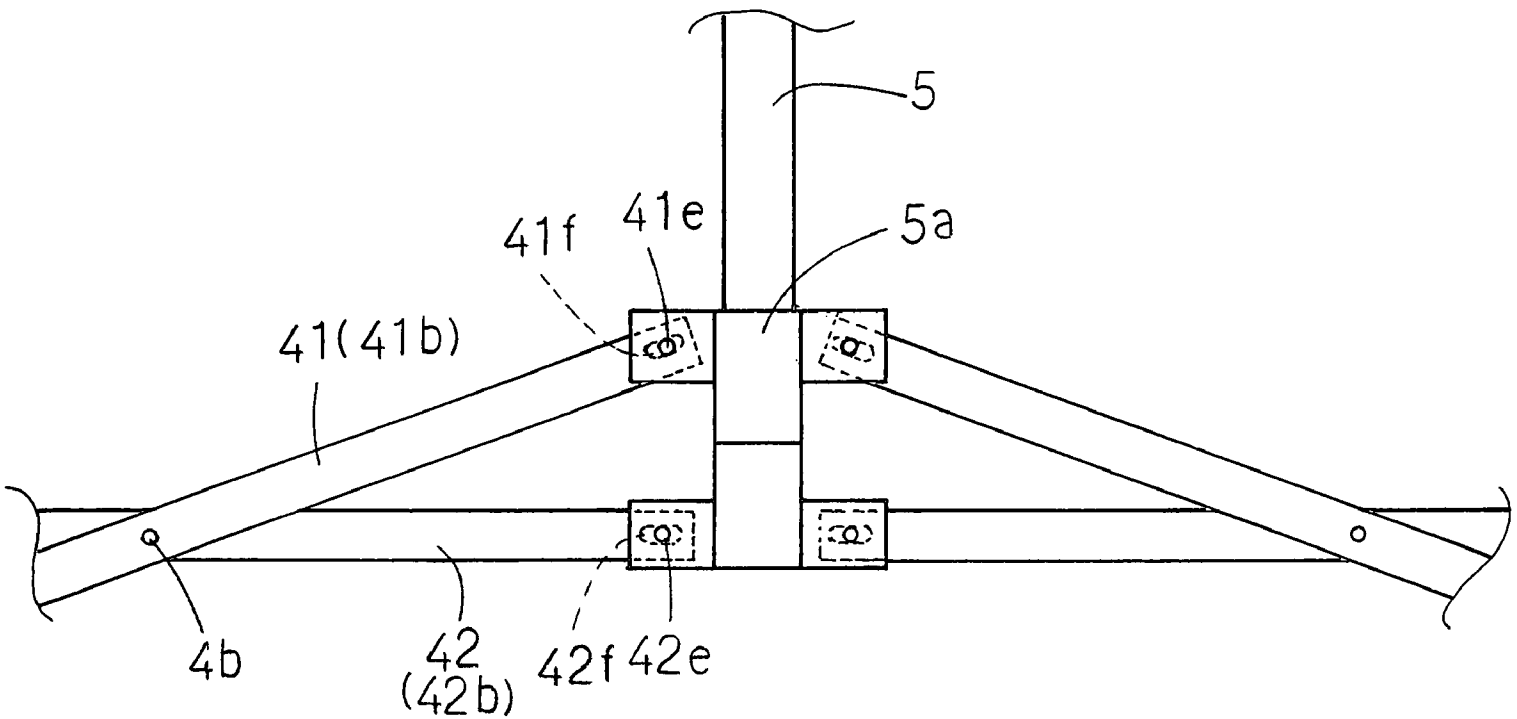
FIG. 4 is an enlarged descriptive view of the principal part of the tent related to the first embodiment.

Further, as shown in FIG. 4, on the end of the center pole 5 side of the reinforcement unit pipe bodies 41*b*, 42*b* is respectively formed with wide holes 41*f*, 42*f* that extend in the lengthwise direction of the pipes 41*b*, 42*b* in this embodiment, said pipe bodies 41*b*, 42*b* are respectively, through the wide holes 41*f*, 42*f*, supported pivotally to the sliding member 5*a* at the center connection point 41*e* and to the center pole 5 at the center connection point 42*e*. In other words, at each of the connection points 41*e*, 42*e* are pivotally supported to be movable along the lengthwise direction of each of the reinforcement unit pipe bodies 41*b*, 42*b*, the direction being intersecting the center pole 5.

Here, since the outer peripheral frames 3 in a plan view are positioned in a manner to correspond to the sides of a substantial square, while the reinforcement frames 4 diagonally corresponds to the substantial square, and slant towards the center pole 5 as a whole, the frames 3, 4 move differently in constructing and in disassembling the tent 1, that is, the moving lengths of the frames 3, 4 differ. Consequently, it may cause trouble moving smoothly with deviations, or further may be unable to fold, if a connection between the reinforcement frame 4 and the pole 2 or the center pole 5 is made only to allow rotation.

As described above, the wide holes 41*f*, 42*f* respectively provided at the connection points 41*e*, 42*e* can resolve the deviations and achieve a smooth operation. Because of this, these wide holes 41*f*, 42*f* are a very important mechanism to fold the tent 1. The strength of the entire tent 1 is also improved.

The dimensions of the respective wide holes 41*f*, 42*f* can be suitably set as long as they resolve the deviations in the connection points 41*e*, 42*e*. Specifically, based on the diameter of the pins that pass through the wide holes 41*f*, 42*f*, it is suitable for the dimensions to be formed 1.5 to 10 times, preferably 2.5 to 4 times. Represented by dimensions, it is 3 mm to 30 mm, preferably 6 mm to 18 mm.

Figure 5B:
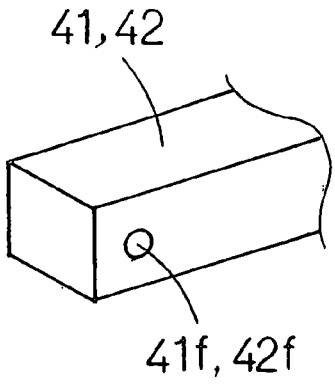
FIG. 5(B) is an enlarged perspective view of the principal part showing the I portion of FIG. 5 (A)
Figure 5C:
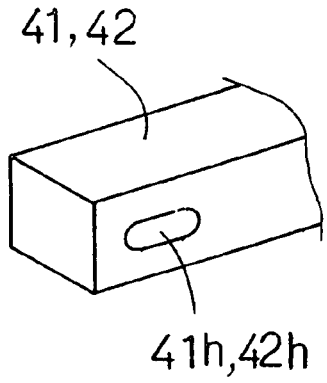
FIG. 5(C) is an enlarged perspective view of the principal part showing the II portion of FIG. 5(B)

Contrary to this, as shown in FIG. 5(A), the portion I located on the center connection point 41*e*, 42*e* side can be round holes 41*f*, 42*f* as shown in FIG. 5(B), while the portion II located on the pole side connection points 41*d*, 42*d* can be wide holes 4*h*, 42*h*, as shown in FIG. 5(C). It is more advantageous that the portion II makes wide holes than that the portion I makes wide holes as the description above, because the wide holes can be formed short. Wide holes can be also formed at both portions I and II, and various modifications may be made as long as the reinforcement frame 4 is supported to be movable in a direction that intersects the poles 2 or the center pole 5.

In this embodiment, wide holes are provided on the reinforcement pipe units 41, 42 side, however, contrary to this, the same effects can be obtained when round holes are provided on the reinforcement pipe units 41, 42 side and wide holes are provided on the poles 2 or the center pole 5 for pivotal supporting. A means other than wide holes can be used as long as the center connection points 41*e*, 42*e* or the pole side connection points 41*d*, 42*d* are pivotally supported to be movable.

The center pole 5, as shown in FIG. 2, is supported by the reinforcement frame 4 and is a bar-shaped member disposed upright in this embodiment.

Additionally, a covering in the shape of a sheet is disposed so as to cover the poles 2, the outer peripheral frame 3, and the center pole 5, and the center pole 5 is to be the top of the roof of the tent 1.

Since the center pole 5 is supported by the reinforcement frame 4 that slants as described above, the length of the center pole 5 can be made relatively shorter, thereby supporting the top of the roof of the tent 1 stably.

Figure 6:
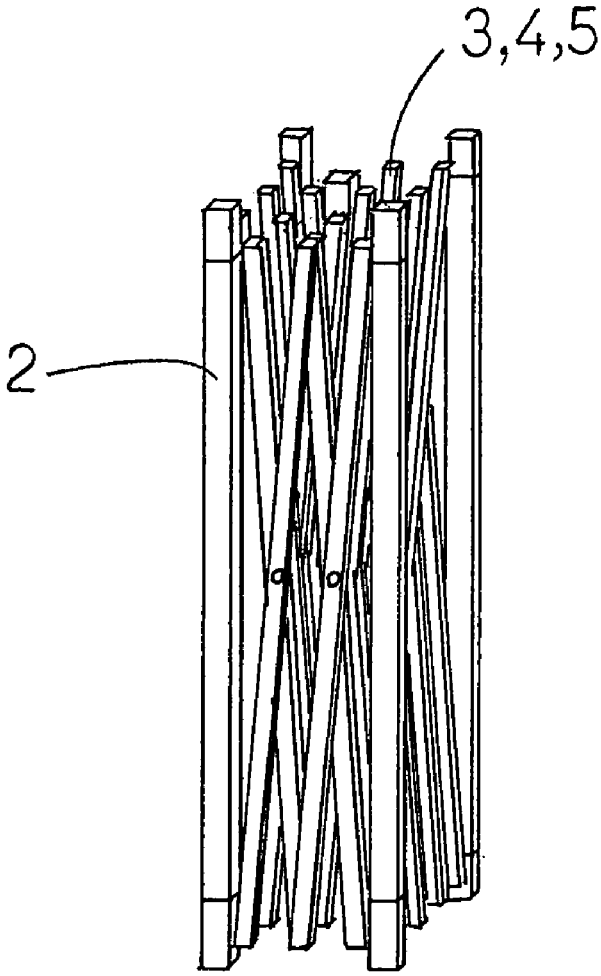
FIG. 6 is a perspective view showing a folded state of the tent of the first embodiment.

Next, a construction way of the tent 1 related to this embodiment will be described. The frame in the folded state as shown in FIG. 6 is placed such that the poles 2 stand upright. For explanation, the covering is omitted in FIG. 6.

Then, the poles 2 are spread radially, i.e. in the back and forth and right and left directions. This allows to extend the outer peripheral frame 3 and the reinforcement frame 4 that have been juxtaposingly folded.

Since the reinforcement frame 4 is formed aslant upwards to the center, the center pole 5 supported by the reinforcement frame 4 in the center is lifted upward as the reinforcement frames 4 are extended.

This stretches the covering that is attached to the poles 2, the outer peripheral frame 3, and the center pole 5.

Then, the poles 2 are extended and the roof with the covering is lifted as necessary. The tent 1 is constructed by these operations.

The lower end of the poles 2 may be just placed on the constructing site such as the ground, however, they can be fastened, for example, by a peg to the constructing site or put on by weights in order not to move due to wind and the like.

As described above, since the foldable tent 1 in the present invention can be constructed simply to extend the poles 2, it is possible to construct it by at least two people.

When the tent 1 is disassembled, it can be done by reversing the described process. Respective bar-shaped members constituting the poles 2 (in such a case a plurality of bar-shaped members are combined in a telescopic manner), and the poles 2 and the sliding members 2*a* are secured by pins or the like in the constructed status, so the securing member is to be disengaged in the disassembling operation.

Here, as depicted in the description regarding the reinforcement frame 4, the first pole side reinforcement unit pipes 41*a* and the second center reinforcement unit pipes 42*b* are disposed level to the constructing site when the tent 1 is constructed, and when the poles 2 are contracted in disassembling the tent 1, the folding point 41*c* of the first reinforcement unit pipe 41 is folded such that it goes downward, enabling a smooth disassembling operation.

For the material of the poles 2, outer peripheral frames 3, and reinforcement frames 4 of the foldable tent 1 in the present invention, various materials may be used such as steel that has been treated anti-corrosion by painting, plating and the like, aluminum alloy, or plastic. Also, in this embodiment, hollow angled pipes are used, however, round pipes can be used. In the case of light material such as plastic, solid one may be used instead of hollow pipe. Taking weight, strength, durability, costs and other factors into general consideration, as described above, most appropriate materials may be applied depending on needs of uses or their purposes.

Though sufficient in the above-described structure, as shown in FIGS. 7 and 10, the strength can be further improved by adding to the tent 1 of this embodiment a reinforcement member 6 that links the outer peripheral frame 3 and the center pole 5.

Figure 8:
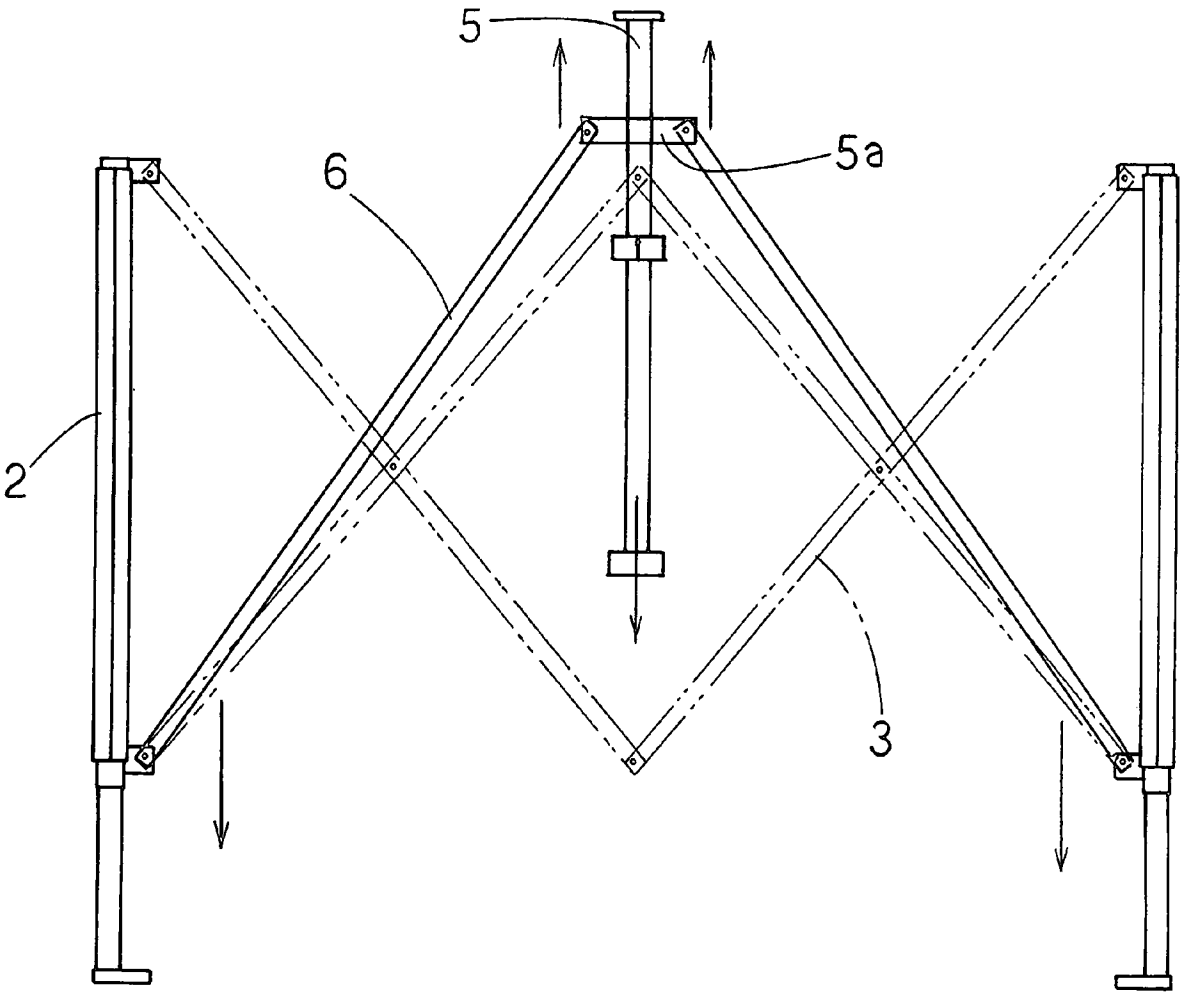
FIG. 8 is a descriptive view showing the operation of the reinforcement member when the tent shown in FIG. 7 is folded.

The reinforcement member 6 shown in FIG. 7 is a bar-shaped member with one end connected to the sliding member 5*a* and the other end to the folding point 31*c* on the lower side in the figure of the outer peripheral frame 3, and when the tent 1 is folded, the one end of this reinforcement member 6 goes up and the other end goes down, as shown in FIG. 8.

Figure 15:
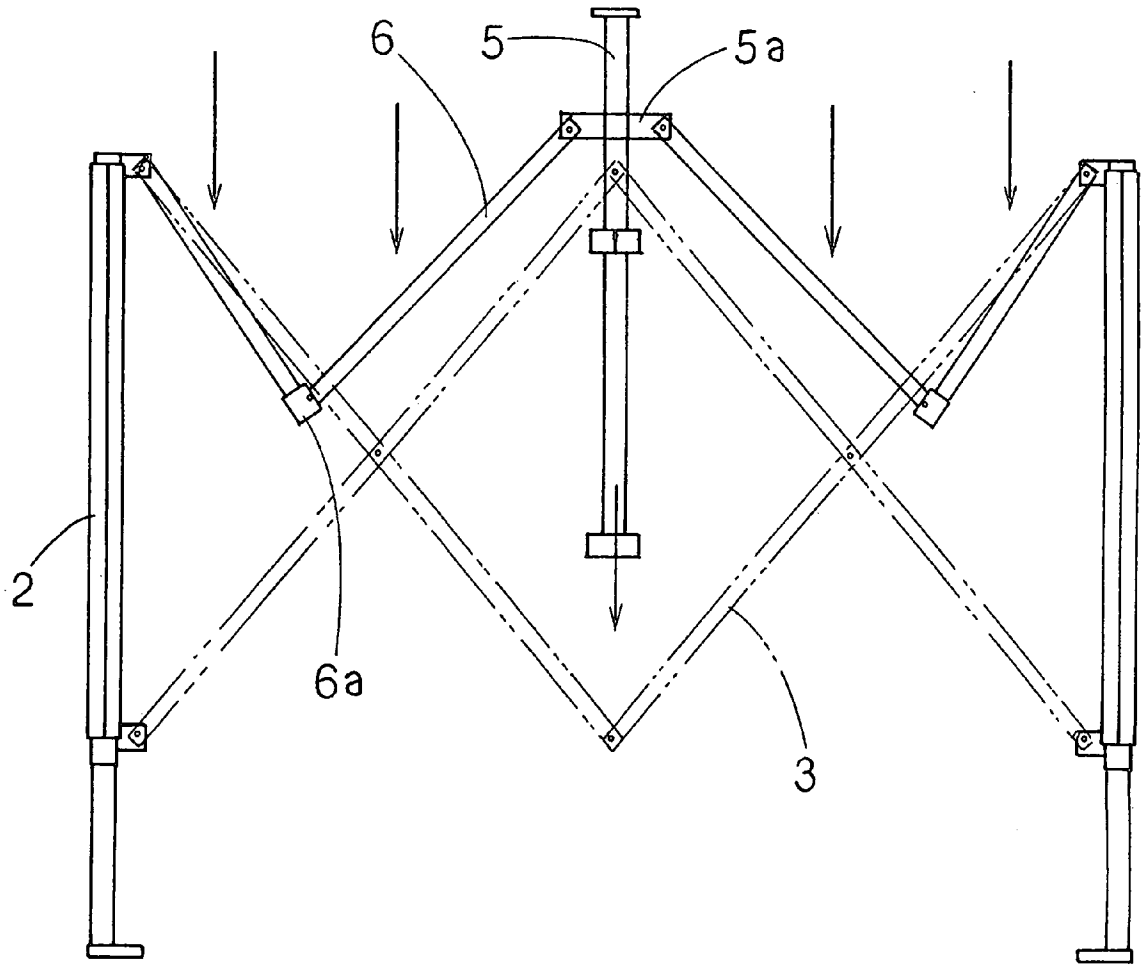
FIG. 15 is a descriptive view showing the operation of the reinforcement member when the tent shown in FIG. 8 is folded.

Also, the reinforcement member 6 shown in FIG. 10 can be folded at folding point 6*a* into a V-shape and folded. Among the members, regarding the reinforcement member 6 disposed parallel to the long side of the outer peripheral frame 3, one end thereof is connected to the sliding member 5*a* with the other end connected to the intersecting point 3*a* positioned at the center of the short side of the outer peripheral frame 3, while, regarding the reinforcement member 6 disposed parallel to the short side of the outer peripheral frame 3, one end thereof is connected to the sliding member 5*a* with the other end connected to the folding point 31*c* on the upper side in the figure positioned at the center of the long side of the outer peripheral frame 3. As shown in FIG. 15, the folding point 6*a* of this reinforcement member 6 goes down in folding the tent 1.

Both embodiments of the reinforcement member 6 described above can be applied to the tent 1 of a first embodiment 1 (see FIG. 7) and to the tent 1 of a second embodiment (see FIG. 10) described later.

This reinforcement member 6 may be formed in a juxtaposing shape like the outer peripheral frame 3 and the reinforcement frame 4 described above.

As shown in the dotted lines in FIGS. 5(A), 7 and 10, a supplemental reinforcement member 6' can be provided other than the reinforcement member 6. Regarding a supplemental reinforcement member 6' shown in FIG. 7, one end thereof is connected to the sliding member 5*a* with the other end connected to the intersecting point 3*a* of the outer peripheral frame 3, while, regarding a supplemental reinforcement member 6' shown in FIG. 10, one end thereof is connected to the sliding member 5*a* with the other end connected to the folding point 32*c* of the outer peripheral frame 3. Like the reinforcement member 6, the supplemental reinforcement member 6' may be variously modified, for example, as one-piece bar-shaped member, a member that can be folded into a V-shape and folded, or in a juxtaposing shape.

As for the reinforcement member 6 shown in FIG. 10, a stopper 6*b* is provided in a manner to wrap the folding point 6*a*, and sliding of the stopper 6*b* along the reinforcement member 6 can switch the reinforcement member 6 between in a secured state and in a foldable state, whereby the reinforcement member 6 is not going to fold accidentally in constructing the tent 1.

In this embodiment, the poles 2 and the outer peripheral frame 3 are formed in a substantial square in a plan view, however, it is not limited to this, and, as shown in FIGS. 9(A) and 9(B), a plurality of the tent 1 shown in FIG. 1 can be connected into a various of polygons (a linking type) such as a rectangle or hexagon to share the sides. Also, the tent 1 may be modified to have a structure to be provided with a linking member to link a plurality of tents 1 only as needed.

Figure 9:
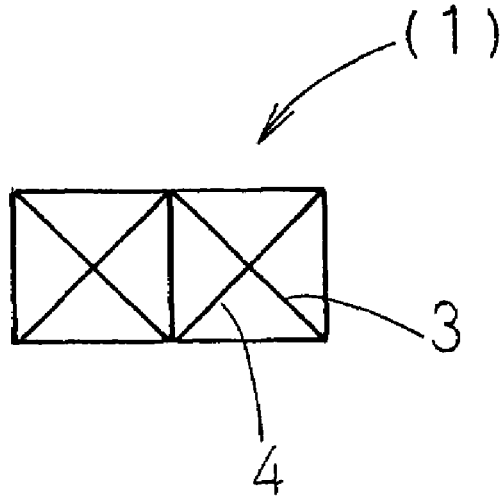
FIGS. 9(A) and 9(B) are descriptive views showing the tent related to another embodiment of the invention of this application.
Figure 9:
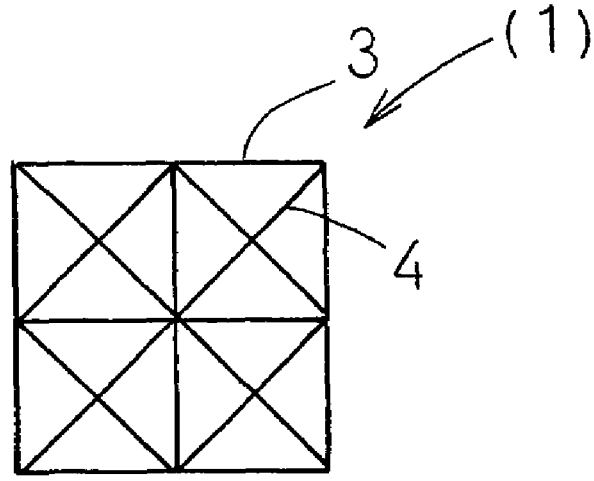
Figure 11:
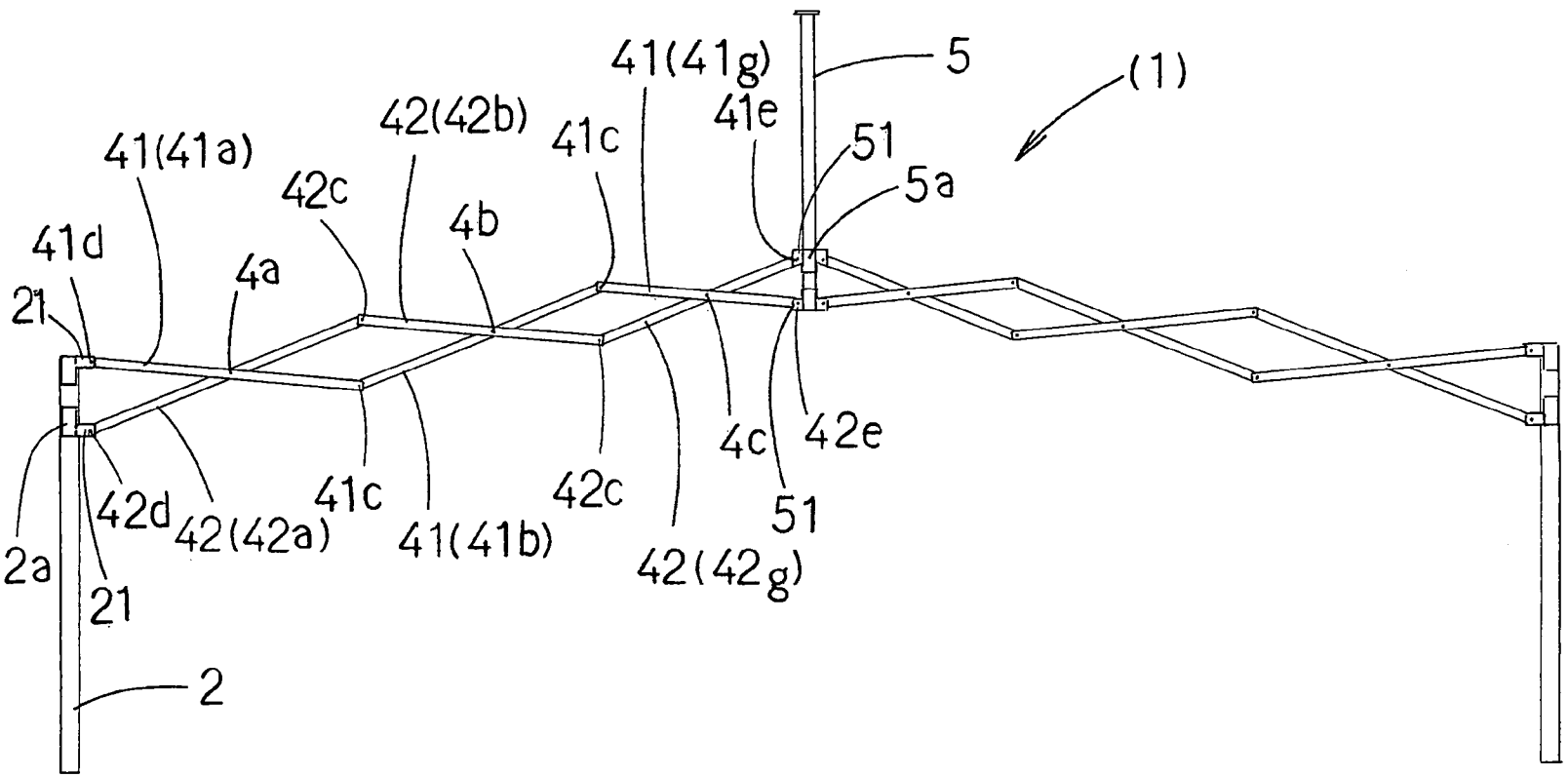
FIG. 11 is a descriptive view showing the structure of the tent of the second embodiment.

A second embodiment of the present invention will be described here with the tent 1 being a single type like one shown in FIG. 1, not the aforementioned linking type shown in FIG. 9, and has a rectangular shape in a plan view. FIG. 10 is a descriptive view showing a structure of the tent 1 in this embodiment, and FIG. 11 is a descriptive view showing a structure of the reinforcement frame 4. Since the structure of the tent 1 of the second embodiment is basically the same as the first embodiment described above, the differences to the first embodiment will be mainly described.

In the second embodiment, since the length of the long sides is longer than the short sides in a plan view, the outer peripheral frame 3 is comprised of more components of outer peripheral pipe units 31, 32 on the long side than the first embodiment. Specifically, as shown in FIG. 10, each of the two pairs of the outer peripheral pipe units 31, 32 provided between pairing poles 2 includes four of the intersecting points 3*a* and three of the folding points 31*c*, 32*c*.

Likewise, the reinforcement frame 4 positioned diagonally in a rectangle is comprised of more components of reinforcement pipe units 41, 42 than the first embodiment. Specifically, as shown in FIG. 11, the reinforcement frame 4 is comprised of a first pole side reinforcement unit pipe body 41*a*, second pole side reinforcement unit pipe body 42*a*, first intermediate reinforcement unit pipe body 41*b*, second intermediate reinforcement unit pipe body 42*b*, first center reinforcement unit pipe body 41*g*, and second center reinforcement unit pipe body 42*g*. Between the first pole side reinforcement unit pipe body 41*a* and the second pole side reinforcement unit pipe body 42*a*, they are pivotally supported at a pole side intersecting point 4*a* to allow rotation, as between the first intermediate reinforcement unit pipe body 41*b* and the second intermediate reinforcement unit pipe body 42*b* at an intermediate intersecting point 4*b*, and as between the first center reinforcement unit pipe body 41*g* and the second center reinforcement unit pipe body 42*g* at a center intersecting point 4*c*. Further, the first pole side reinforcement unit pipe 41*a*, first intermediate reinforcement unit pipe 41*b*, and first center reinforcement unit pipe 41*g* are pivotally supported at folding points 41*c*, 41*c* to allow rotation to comprise the first reinforcement pipe unit 41, while the second pole side reinforcement unit pipe 42*a*, second intermediate reinforcement unit pipe 42*b*, and second center reinforcement unit pipe 42*g* are pivotally supported at folding points 42*c*, 42*c* to allow rotation to comprise the second reinforcement pipe unit 42.

Here, as for a trial tent 1 the inventor produced with different lengths between the short sides and the long sides of the outer peripheral frame 3 as described in this embodiment, folding of the tent caused trouble, when the poles 2 were not moved for a distance as per a ratio between the short sides and the long sides, of hindering with of the reinforcement frame 4, thus failing in smooth folding, or being unable to be folded, resulting in non-usability.

Figure 12:
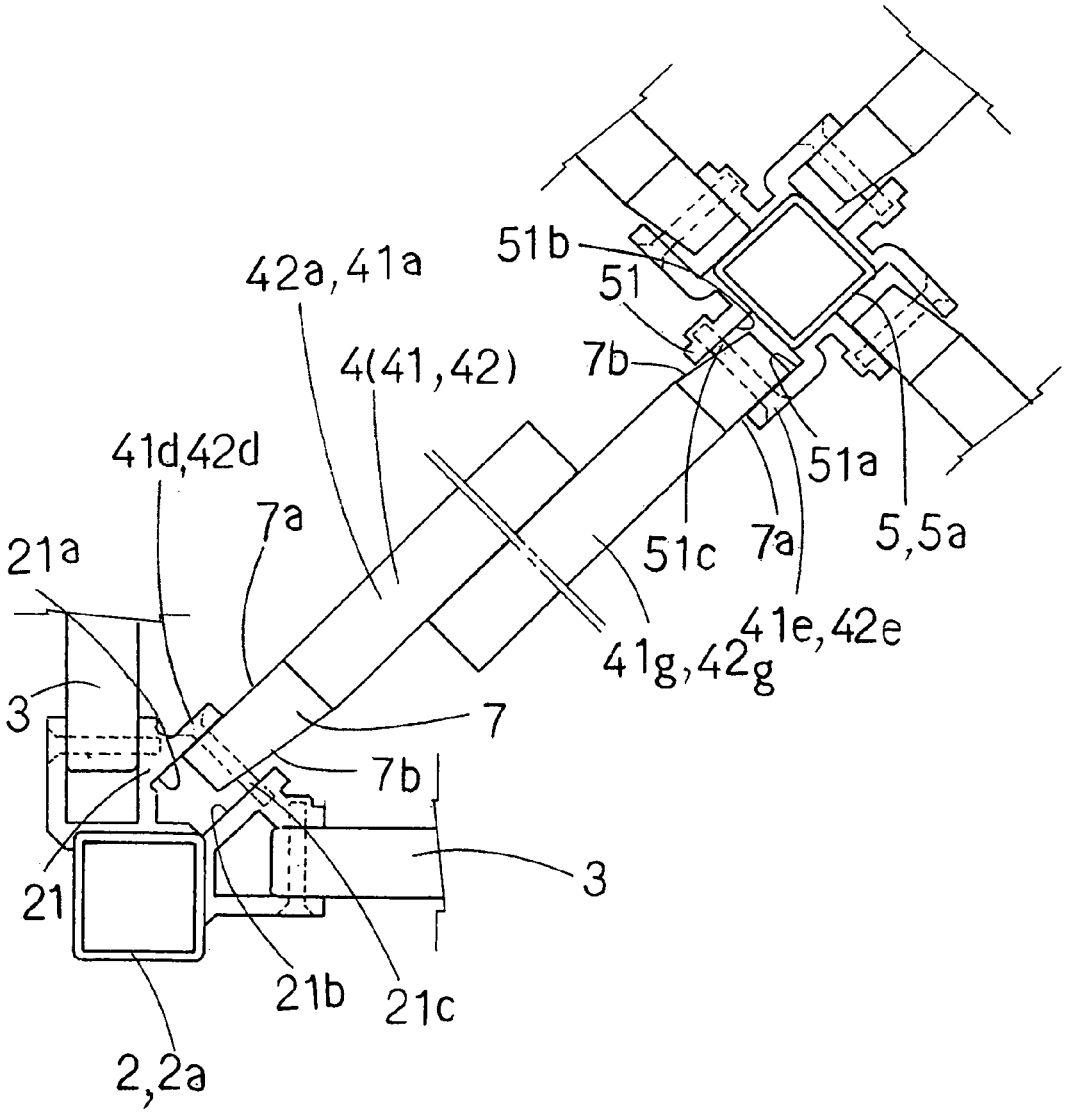
FIG. 12 is a descriptive view showing the structure of the reinforcement frame related to the second embodiment.
Figure 13:
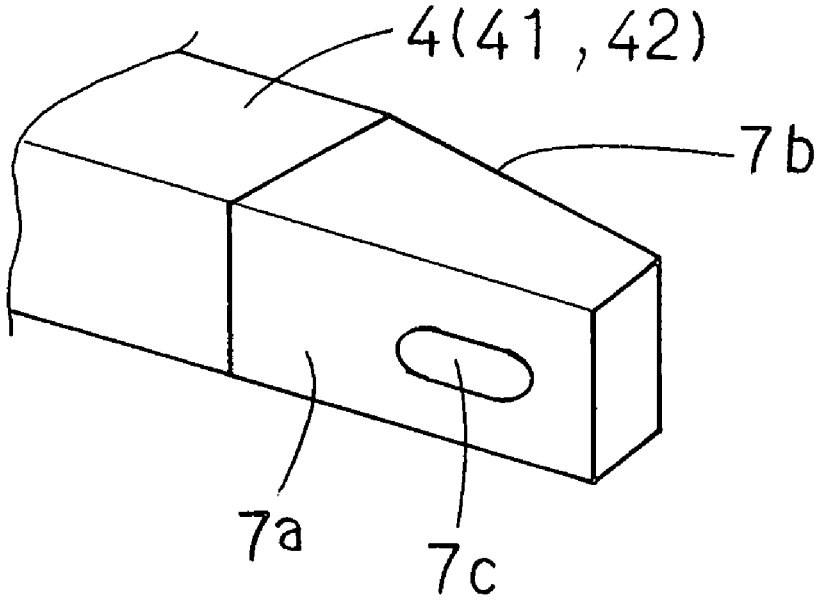
FIGS. 13(A) and 13(B) are descriptive views showing the structure of the end of the reinforcement frame.
Figure 13:
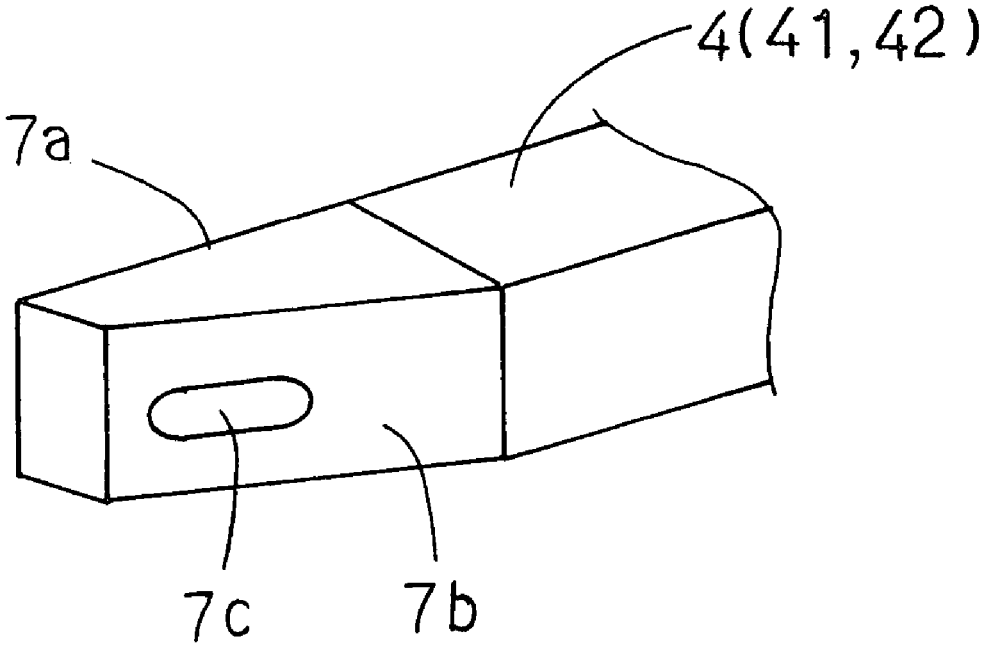

In the second embodiment, in order to solve this problem, a terminal connection portion 7 (see FIG. 12) of the poles 2 and the center pole 5, the portion being both ends of the first reinforcement pipe unit 41 and second reinforcement pipe unit 42 on the reinforcement frame 4, in addition to a structural pattern in the first embodiment, has play for movement within a specified range in the substantially peripheral direction on the basis of the poles 2 and the center pole 5 to be able to move like turning a head. Specifically, the terminal connection member 7 having a tapering wedge shape shown in FIG. 12 is pivotally supported with the poles 2 or the center pole 5 through a wide hole 7*c* formed so as to penetrate the terminal connection member 7 shown in FIGS. 13(A) and 13(B). Regarding the above-described wedge shape, on one end of the terminal connection member 7 is disposed a parallel surface 7*a* that is parallel to the longitudinal direction of each of the unit pipe bodies 41*a*, 42*a*, 41*g*, 42*g* that have the terminal connection member 7, while on the other end is disposed a flat sloping surface 7*b* that diminishes the distance between the parallel surface 7*a* and the face as it goes towards the terminal side. The wide hole 7*c*, which is the same as the wide holes 41*f*, 42*f* described in the first embodiment, is formed in the vertical direction with respect to the parallel surface 7*a* and extends in the longitudinal direction of each of the unit pipe bodies 41*a*, 42*a*, 41*g*, 42*g*.

Figure 14:
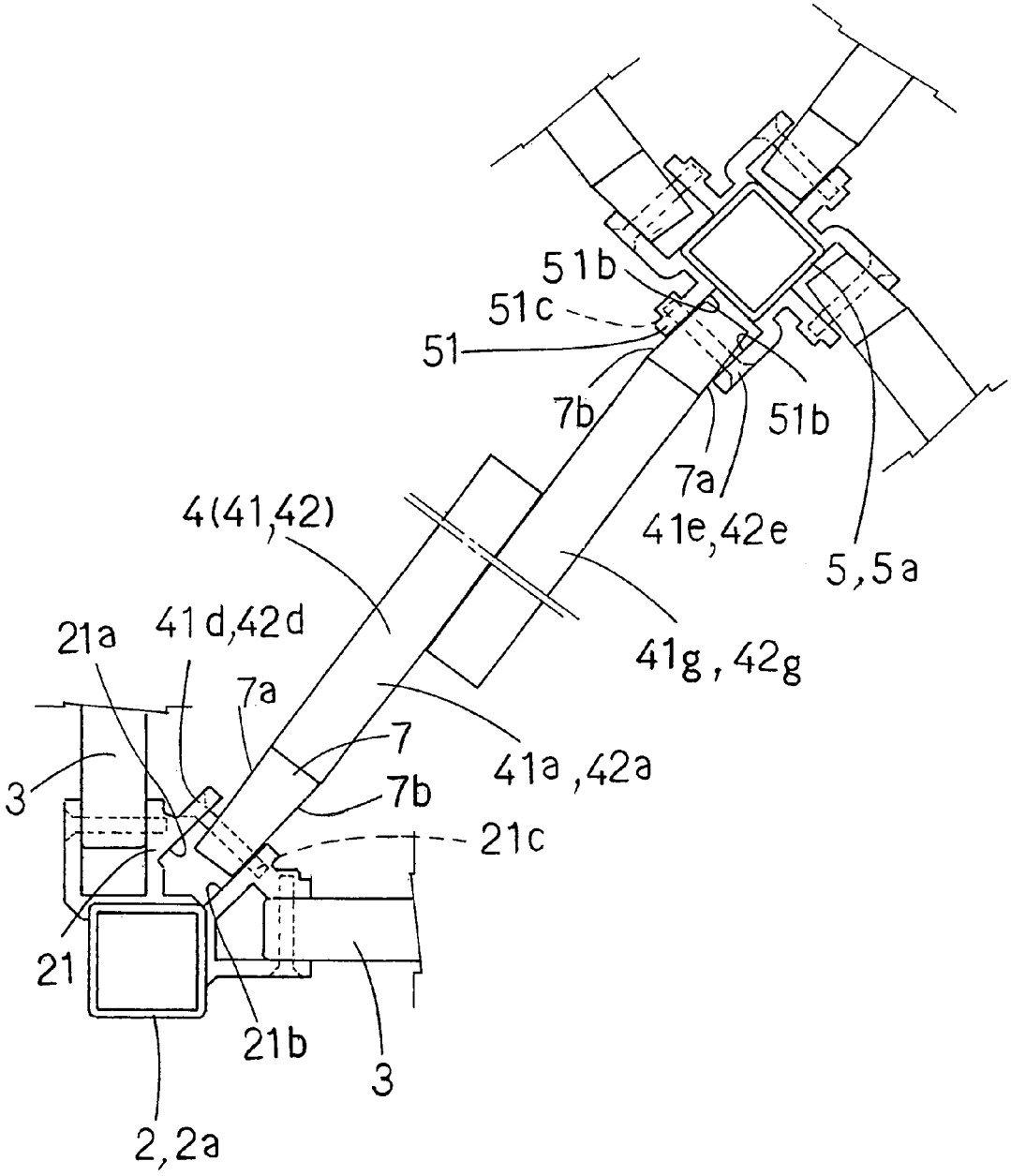
FIG. 14 is a descriptive view showing the structure of the reinforcement frame related to the second embodiment.

In respect of the poles 2 and on the sliding member 2*a* on the pole side, a bracket 21 is provided with the pole side connection point 41*d* of the first reinforcement unit pipe 41 to the pole 2, and with the pole side connection point 42*d* of the second reinforcement unit pipe 42 to the pole 2, as well as, in respect of the center pole 5 and on the sliding member 5*a* on the center pole side, a bracket 51 is provided with the center connection point 41*e* of the first reinforcement unit pipe 41 to the center pole 5, and with the center connection point 42*e* of the second reinforcement unit pipe 42 to the center pole 5. As shown in FIGS. 12 and 14, the bracket 21, 51 respectively has an inner surface 21*a*, 51*a* on one side and the other inner surface 21*b* 51*b* opposing thereto, where the above-described terminal connection member 7 positioned between both surfaces is pivotally supported to allow rotation by a support pins 21*c*, 51*c* disposed therebetween.

Thanks to the shape of the terminal connection member 7 and pivotal support through the wide hole 7*c*, since the reinforcement frame 4 is movable like turning a head within a range from a status where, as shown in FIG. 12, the inner surface 21*a*, 51*a* of the bracket 21, 51 and the parallel surface 7*a* of the aforementioned terminal connection member 7 touch while there is a gap between the inner surface 21*b*, 51*b* on the other side and the sloping surface 7*b* of the terminal connection member 7, to a status where, as shown in FIG. 14, there is a gap between the inner surface 21*a*, 51*a* of the bracket 21, 51 and the parallel surface 7*a* of the terminal connection member 7 while the inner surface 21*b*, 51*b* on the other side and the sloping surface 7*b* of the terminal connection member 7 touch, the tent can be smoothly folded even if a ratio of the movement distance regarding the poles 2 in folding the tent 1 does not follow the ratio between the short sides and long sides. Therefore, the terminal connection member 7 in this type of shape is a highly important mechanism to fold the tent 1. Also, the overall strength of the tent 1 is improved.

In this second embodiment, the terminal connection member 7 in a wedge shape like the above description is provided on both the poles 2 side and the center pole 5 side, however, the terminal connection member 7 can be provided only on the poles 2 side or the center pole 5 side.

The above-described structure achieves similar effects even with a tent in a substantial square in a plan view as in the first embodiment. The structure is applicable to a tent 1 that has various polygonal shapes besides a rectangle and can flexibly correspond to various purpose of use of the tent 1.

Also, FIG. 10 shows that a reinforcement member 6 that links the outer peripheral frame 3 and the center pole 5 is provides, however, as described, the present invention does not concern whether the reinforcement member 6 is present or not, and the member may be omitted. In contrast, a supplemental reinforcement member 6' shown in a dotted line in FIG. 10 can be also provided.

The present invention has the following excellent effects.

According to first aspect of the present invention, compared to a conventional tent, the strength is improved by the reinforcement frames being formed that passes through the inside of a polygon in a plan view formed by the outer peripheral frame and being disposed to link each of the poles and the center of the polygon. Thus, it is not necessary to separately provide a reinforcing material as is done conventionally, however, if a reinforcing material is provided, the strength can be improved more.

According to the second aspect of the present invention, the connection point positioned on the upper side of the reinforcement frame with respect to the center pole is at a higher position compared to the connection point on the lower side of the reinforcement pipe units with respect to the poles, and the center pole is stably supported.

According to the third aspect of the present invention, since one portion of the bar-shaped member comprising the reinforcement pipe unit is disposed level or aslant downward to the direction of the center, the reinforcement pipe units are smoothly folded in dissembling the tent.

According to the fourth aspect of the present invention, since the length on the pole side is larger than the length on the center pole side regarding the sliding length at the connection point of the reinforcement frame, the principle of leverage applies to lifting the center pole with a small effect, facilitating to spread the covering in constructing the tent.

According to the fifth aspect of the present invention, since the reinforcement frames are supported to be movable in the direction to intersect the poles or to intersect the center pole at the connection point thereof, deviations in operation on the outer peripheral frame and the reinforcement frame can be absorbed, and smooth operation in constructing and dissembling the tent can be achieved.

According to the sixth aspect of the present invention, a rectangular foldable tent can be provided that can flexibly correspond to various usage objectives of the tent.

According to the seventh and eighth aspects of the present invention, the tent can be smoothly folded even when the ratio of the movement distance of the poles is not as per the ratio between the short sides and the long sides in folding the tent.

What is claimed is:

1. A foldable tent, comprising:

a covering;

a plurality of outer poles; and a plurality of frames connected to the outer poles, wherein the frames include a plurality of outer peripheral frames that define an outer peripheral shape of the frames, and a plurality of reinforcement frames disposed inside of and surrounded by the outer peripheral frames, and the outer peripheral frames are disposed on an upper portion of the poles to link neighboring outer poles and to form a polygon, wherein each of the outer poles are positioned at the vertexes of the polygon in a plan view, and each of the outer poles is connected to a respective one of the reinforcement frames, the reinforcing frames extending from the outer poles in a direction towards a center of the polygon, and the foldable tent further comprising:

a center pole provided at the center of the polygon and supported by the reinforcement frames, wherein each of the outer peripheral frames and each of the reinforcement frames includes two or more pairs of combined pipe units, at least one intersecting point being formed at each of the pipe units, one of the pipe units and the other pipe unit being joined at the intersecting points to allow rotation, the outer peripheral frames and the reinforcement frames being foldable by changing an angle between adjacent one of the pipe units, and wherein the covering is supported by the poles, the outer peripheral frames and the reinforcement frames, wherein the two or more pairs of combined pipe units of the reinforcement frames serve as reinforcement pipe units, and each includes two or more pairs of reinforcement unit pipe bodies that are foldably connected end-to-end one to another, each of the two or more pairs of reinforcement unit pipe bodies including a first unit pipe body and a second unit pipe body, each of which has one of the intersecting points formed at an intermediate point along its length, and a folding point formed at each end thereof, the first unit pipe body and the second unit pipe body of each pair of reinforcement unit pipe bodies being rotatably connected to each other at their respective intersecting points, the first unit pipe bodies of the two or more pairs of reinforcement unit bodies being arranged end-to-end and being foldably connected at their folding points, and the second unit pipe bodies of the two or more pairs of reinforcement unit bodies being arranged end-to-end and being foldably connected at their folding points, thereby allowing rotation between adjacent ones of the reinforcement unit pipe bodies, and enabling the reinforcement frames to be foldable, wherein the folding points of the first and second unit pipe bodies closest to the center pole serve as pairs of connection points to the center pole, and the folding points of the first and second unit pipe bodies closest to the outer poles serve as pairs of connection points to the outer poles, and when the tent sets on a horizontal surface, the pairs of connection points of the first and second unit pipe bodies closest to the center pole are at higher positions than positions of the pairs of connection points of the first and second unit pipe bodies closest to the outer poles, wherein one of the two connection points at each of the outer poles is adapted to be slidable upwardly and downwardly by a first predetermined distance, and one of the two connection points at the center pole is adapted to be slidable upwardly and downwardly by a second predetermined distance smaller than the first predetermined distance, wherein the other of the two connection points at each of the outer poles and the center pole not adapted to slide upwardly and downwardly, and wherein all of the connection points at the outer poles and the center poles are adapted to be rotatable around axes of the poles.

2. The foldable tent as set forth in claim 1, wherein the two or more pairs of combined pipe units of the outer peripheral frames serve as outer peripheral pipe units, and each includes two or more pairs of outer peripheral unit pipe bodies that are foldably connected end-to-end one to another, each of the two or more pairs of unit pipe bodies including a first unit pipe body and a second unit pipe body, each of which has an intersecting point formed at an intermediate point along its length, and a folding point formed at each end thereof, the first unit pipe body and the second unit pipe body of each pair of outer peripheral unit pipe bodies being rotatably connected to each other at their respective intersecting points, the first unit pipe bodies of the two or more pairs of unit bodies being arranged end-to-end and being foldably connected at their folding points, and the second unit pipe bodies of the two or more pairs of outer peripheral unit bodies being arranged end-to-end and being foldably connected at their folding points, thereby allowing rotation between adjacent ones of the outer peripheral unit pipe bodies, and enabling the outer peripheral frames to be foldable.

3. The foldable tent as set forth in claim 2, when the tent sets on the horizontal surface, at least one of the first and second unit pipe bodies is arranged to be parallel to the horizontal surface or is arranged to slope downwardly from the center of the polygon towards the outer poles.

4. The foldable tent as set forth in claim 1, at least one of the connection points connecting the reinforcement frames to the center pole, and at least one of the connection points connecting the reinforcement frames to the outer poles is provided with play that allows movement in a direction to intersect the outer poles, or to intersect the center pole.

5. The foldable tent as set forth in claim 1, wherein the outer peripheral shape defined by the outer peripheral frames is a rectangle formed by two opposing long sides and two short sides disposed at both ends of the long sides.

6. The foldable tent as set forth in claim 1, wherein at least one of the connection points connecting the reinforcement frames to the center pole, and at least one of the connection points connecting the reinforcement frames to the outer poles is provided with play for movement within a specified range in a substantially peripheral direction of the polygon.

7. The foldable tent as set forth in claim 6, wherein each at least one of the first and second unit pipe bodies that is connected to the outer poles or the center pole and that is provided said play is supported via a bracket provided on the outer poles or the center pole, the bracket having an inner surface on one side and an opposing inner surface on an opposite side, between which a terminal connection member of the unit pipe body is disposed, wherein the unit pipe body is pivotally supported by a support pin disposed between the inner surface of the bracket to allow rotation around the support pin, the terminal connection member of the unit pipe body having a tapering wedge shape, one side of the terminal connection member being provided with a parallel surface that is parallel to a longitudinal direction of the unit pipe body, an opposite side of the terminal connection member being provided with a flat sloping surface that diminishes a distance between the parallel surface and the flat sloping surface in a direction towards the end of the unit pipe body, the terminal connection member including a hole penetrating therethrough in a direction orthogonal to the parallel surface, the hole being longer in the longitudinal direction of the unit pipe body than in a direction orthogonal to the longitudinal direction of the unit pipe body, wherein the terminal connection member is movable with respect to the bracket within a predetermined range from a status where the inner surface of the bracket and the parallel surface of the terminal connection member touch, while there is a gap between the inner surface on the opposite side and the sloping surface of the terminal connection member, to a status where there is a gap between the inner surface of the bracket and the parallel surface of the terminal connection member, while the inner surface on the other side and the sloping surface of the terminal connection member touch.

8. A foldable tent, comprising:

a covering;

a plurality of outer poles; and a plurality of frames connected to the outer poles, wherein the frames include a plurality of outer peripheral frames that define an outer peripheral shape of the frames, and a plurality of reinforcement frames disposed inside of and surrounded by the outer peripheral frames, and the outer peripheral frames are disposed on an upper portion of the poles to link neighboring outer poles and to form a polygon, wherein each of the outer poles are positioned at the vertexes of the polygon in a plan view, and each of the outer poles is connected to a respective one of the reinforcement frames, the reinforcing frames extending from the outer poles in a direction towards a center of the polygon, and the foldable tent further comprising:

a center pole provided at the center of the polygon and supported by the reinforcement frames, wherein each pair of the reinforcement frames, disposed between the outer poles and the center pole includes a first outer pole side reinforcement unit pipe body, a second outer pole side reinforcement unit pipe body, a first center reinforcement unit pipe body, and a second center reinforcement unit pipe body, wherein the first outer pole side reinforcement unit pipe body and second outer pole side reinforcement unit pipe body are pivotally supported at outer pole side intersecting points, while the first outer pole side reinforcement unit pipe body and first center reinforcement unit pipe body are pivotally supported at folding points, thus forming a first reinforcement unit pipe, wherein the first center reinforcement unit pipe body and second center reinforcement unit pipe body are pivotally supported at center intersecting points, while the second outer pole side reinforcement unit pipe body and second center reinforcement unit pipe body are pivotally supported at other ones of the folding points, thus forming a second reinforcement unit pipe, in the first and second reinforcement unit pipes, when the length of the intervals defined at the outer pole side intersecting points, the folding points, and the center intersecting points, are respectively, from an outer pole side, a first interval, second interval, third interval, and fourth interval, the second interval is shorter than the first interval, the second and third intervals being equal, the fourth interval being shorter than the third interval, wherein each of the first outer pole side reinforcement unit pipe body, the second outer pole side reinforcement unit pipe body, the first center reinforcement unit pipe body, and the second center reinforcement unit pipe body includes a connection point, the connecting points for connecting the first outer pole side reinforcement unit pipe body and the second outer pole side reinforcement unit pipe body to one of the outer poles, and for connecting the first center reinforcement unit pipe body and the second center reinforcement unit pipe body to the center pole, and when the tent sets on a horizontal surface, the connection points of the first center reinforcement unit pipe body and the second center reinforcement unit pipe body are at higher positions than positions of the pairs of connection points of the first outer pole side reinforcement unit pipe body and the second outer pole side reinforcement unit pipe body.

9. A foldable tent as set forth in claim 8, wherein the outer peripheral frames include outer peripheral pipe units, each of which includes two pairs of outer peripheral unit pipe bodies that are foldably connected end-to-end one to another, each of the two pairs of unit pipe bodies including a first unit pipe body and a second unit pipe body, each of which has an intersecting point formed at an intermediate point along its length, and a folding point formed at each end thereof, the first unit pipe body and the second unit pipe body of each pair of outer peripheral unit pipe bodies being rotatably connected to each other at their respective intersecting points.

* * * * *